US005328594A

United States Patent [19]

Hettinger

[11] Patent Number: 5,328,594

[45] Date of Patent: * Jul. 12, 1994

[54] MAGNETIC SEPARATION OF OLD FROM NEW CRACKING CATALYST BY MEANS OF HEAVY RARE EARTH "MAGNETIC HOOKS"

[75] Inventor: William P. Hettinger, Russell, Ky.

[73] Assignee: Ashland Oil, Inc., Ashland, Ky.

[ * ] Notice: The portion of the term of this patent subsequent to Dec. 15, 2009 has been disclaimed.

[21] Appl. No.: 986,234

[22] Filed: Dec. 7, 1992

Related U.S. Application Data

[63] Continuation of Ser. No. 601,834, Oct. 22, 1990, Pat. No. 5,171,424.

[51] Int. Cl.[5] ..... C10G 11/04; C10G 11/18

[52] U.S. Cl. ..... 208/121; 208/113; 208/52 CT; 208/149; 208/152; 208/251 R; 209/9; 209/636

[58] Field of Search ..... 208/113, 121, 52 CT, 208/144, 152, 251 R; 209/8, 636

[56] References Cited

U.S. PATENT DOCUMENTS 5,171,424 12/1992 Hettinger ..... 208/121

*Primary Examiner*—Helane Myers

*Attorney, Agent, or Firm*—Richard C. Willson, Jr.

[57] ABSTRACT

This invention relates to an improved catalytic process for carrying out heavy hydrocarbon conversion, usually, but not necessarily, in the presence of nickel and vanadium on the catalyst and in the feedstock, by catalytic cracking gas oils and heavy carbometallic oils to lighter molecular weight fractions. The process is facilitated by the continuous addition of one or more heavy rare earth additives, including gadolinum, terbium, dysprosium, holmium, erbium, and thulium, all having exceptionally high paramagnetic properties, which as they accumulate on aged catalyst, are used to achieve enhanced magnetic separation of aged catalyst. These additives are unusual in that they not only act dramatically as magnetic hooks to assist in removing old, nickel and vanadium poisoned catalyst, but also act to achieve increased activity and improve selectivity of the remaining catalyst, and of equal importance, tend to resist catalyst deactivation. This invention takes advantage of the unusual paramagnetic properties of unpaired sheltered f shell electrons of the heavy rare earths, as well as the enhanced catalytic properties resulting from accumulation of the heavy rare earths on circulating catalyst, and utilizes them as so-called enriching or amplifying "magnetic hooks" to separate more magnetically active, older, less catalytically active and selective, higher metals containing catalyst particulates from less magnetically active, lower metal containing particulates. More importantly, by continuous addition of one or more of these elements, continuous isolation of the more catalytically active and selective catalysts fractions are achieved, enabling them to be recycled back to the unit, thus reducing fresh catalyst addition rates and high costs associated therewith.

39 Claims, 20 Drawing Sheets

MAGNETIC SEPARATION OF OLD FROM NEW CRACKING CATALYST BY MEANS OF HEAVY RARE EARTH "MAGNETIC HOOKS"

This application is a continuation, of application Ser. No. 601,834, filed Oct. 22, 1990 now U.S. Pat. No. 5,171,424.

BACKGROUND OF THE INVENTION

In industrial fluid bed cracking of hydrocarbon feedstocks, it is the practice, because of the rapid loss in catalyst activity and selectivity, to continuously add fresh catalyst regularly, usually daily, to an equilibrium mixture of catalyst particles. If metals, such as nickel and vanadium, are present in the feedstock, they accumulate almost completely on the catalyst, thus drastically reducing activity, increasing coke and hydrogen production, and reducing selective conversion to gasoline. In such cases of high metal content, catalyst replacement additions may have to rise significantly.

Fluid cracking catalysts consist of small microspherical particles varying in size from 10 to 150 microns, with a majority in the 40–105 micron range, and represent a highly dispersed mixture of catalyst particles that have been present in the unit for as little as one day, while others have been there for as long as 60–90 days or more. Because these particles are so small, no process has been available to remove old catalysts from new. Therefore, it usually is customary to withdraw 1 to 10% or more of equilibrium catalyst containing all of these variously aged particles just prior to addition of fresh catalyst particles, thus providing room for the incoming fresh material. Unfortunately, the 1 to 10% of equilibrium catalyst withdrawn contains, among other things, a likewise 1–10% of the very expensive catalyst added the day before, 1–10% of the catalyst added 2 days ago, 1–10% of the catalyst remaining of the catalyst added 3 days ago, and so forth. Therefore, when removing equilibrium catalyst, it is unfortunate that a very large proportion of withdrawn catalyst still represents very expensive and still very active catalyst.

Catalyst consumption can be very high. The cost associated therewith, especially when high nickel and vanadium are present in any significant amount greater than, for example, 0.1 ppm in the feedstock can, therefore, be very great. Depending on the level of metal content in feed and the desired operating catalyst activity and metal level desired in circulating equilibrium catalyst, tons of catalyst must be added daily. For example, the cost of a catalyst at the point of introduction to the unit can rise as high as $2,000/ton or greater. As a result, a unit consuming 20 tons/day of catalyst would require expenditures each day of at least $40,000. For a unit processing 40,000 B/D this would represent a processing cost of $1/B or 2.5 cents/gallon, for catalyst use alone. The above cost is more or less typical for a residual processing operation.

In addition to catalyst costs, an aged high nickel and vanadium ladened catalyst can also bring about a reduction in yield of valuable and preferred liquid fuel products, such as gasoline and diesel fuel, and instead, produce more undesirable, less valuable products, such as dry gas and coke. As if these two losses are not enough, a high level of nickel and vanadium on catalyst can, in addition, also act to accelerate catalyst deactivation, thus reducing operating profits even more.

Because of this required daily addition of fluid cracking catalyst, there results immediate and complete mixing of these microspherical particulates both fresh in performance and low in contaminants (usually nickel, vanadium, iron, copper, and sodium) with other microspherical particulates high in these adverse elements and very low in activity and which particulates have been in the unit for varying times as long as 60–90 days or even longer. These older catalysts have aged and drastically dropped in performance while simultaneously accumulating these aforementioned deleterious metal contaminants which greatly accelerate catalytically the production of hydrogen and coke as well as dry gas.

As a result, industry has long felt a need to have a means by which the much older catalyst can be selectively removed without inclusion or entrainment of the fresher catalyst in order to reduce catalyst addition rates while at the same time maintaining better activity, selectivity and unit performance. Because of the very small size of these particles, billions of particles are involved, and mechanical separation is impossible even if one could rapidly identify by some means, as for example, color, which particles are old, and which are new.

Related Applications

Previous means to achieve effective magnetic separation of old catalyst from new is covered in U.S. Pat. No. 4,406,773 (1983) of W. P. Hettinger, et al, and discloses use of a high magnetic field gradient separator (HGMS) produced by SALA. A carrousel magnetic separator containing a filamentary matrix within produces a high magnetic field gradient to achieve selective separation.

Subsequent work has uncovered a preferred method of separation involving the use of a magnetic rare earth roller device (RERMS) and a pending application ASSN 07/332,079 filed Apr. 3, 1989 covers the concept of using such a device for magnetic separation. In attempting to further improve separation, it has also been discovered that in the presence of larger amounts of paramagnetic iron, further improvement in separation selectivity can be realized and a pending application U.S. Ser. No. 07/479,003 filed Feb. 9, 1990 (Attorney docket 6345AUS) covers the concept of a "Magnetic Hook" TM, and the use of continuous addition of iron to enhance separation.

A more recent application, Ser. No. 601,965, filed Oct. 19, 1990 now abandoned, covers the discovery of a highly superparamagnetic specie, which when present in aged equilibrium catalyst, further improves separation due to its very high magnetic susceptibility compared to normal paramagnetic iron described in docket 6345AUS.

A still more recent application, Ser. No. 602,455, filed Oct. 19, 1990 now U.S. Pat. No. 5,190,898 covers the use of manganese as a "magnetic hook" additive that not only facilitates selective removal of old catalyst, but also serves to reduce activity decline, and improve catalyst performance by reducing coke and hydrogen make and increasing gasoline yield selectivity.

SUMMARY OF THE INVENTION

This invention introduces a novel means of magnetically separating old catalyst from new by continuous addition of one or more additives which includes members of the so-called "heavy" rare earth family, namely, gadolinum, terbium, dysprosium, holmium, erbium, and thulium, which possess extremely high paramagnetic properties. These additives, when added continuously, or periodically, directly or indirectly, to equilibrium catalyst either alone, or in combination, serve to amplify or enhance by their presence the magnetic properties of those older catalyst particles which have, as they age, accumulated nickel, iron, and vanadium in gradually increasing amounts. Because of the unusual properties of these heavy rare earths, they can also be utilized to separate old catalyst from new even in cases where no metal contaminants are involved. By adding these highly effective magnetic property enhancing additives, in quantities as high as 50,000 ppm, magnetic separations of old catalyst from new is greatly improved. In addition, it has been discovered that by inclusion of these effective magnetic additives to the catalyst, that catalyst activity is also enhanced in a most striking fashion, and resistance to deactivation also increased as much as 150%.

Gadolinium, terbium, dysprosium, holmium, erbium, and thulium can be utilized as "magnetic hook" additives in many different ways. Inorganic salts of these elements can be dissolved in water, and as the inorganic additive compound, dispersed in the feedstock as water in oil emulsion, and added either continuously or periodically to the reactor as a part of the total feed. They can also be added as an inorganic salt dissolved in water and said solution sprayed directly onto the catalyst entering the reactor, or to the catalyst entering or leaving the regenerator, so as to deposit on the catalyst directly. They can also be added as an organic compound, as for example, an alcoholate or an acetylacetonate to the oil feedstock or added directly to the reactor by dissolving in a separate organic solvent and/or a small portion of the feedstock. The most important concept for the process, however, is that it be introduced in such a manner as to deposit continuously and/or periodically on the entire equilibrium catalyst, so that buildup of the additive on any single particle is specifically tied to the time that the specific individual particle has been in the system. The amount of additive to be added is determined continuously by observing the effectiveness of separation and by balancing additive costs versus benefits. The additive can be added continuously or periodically at any rate between 0.1 ppm and 100 ppm of metal per million parts of oil, so as to deposit on said equilibrium catalyst and to be present in amounts from 100 to 10,000 ppm, with the concentration of additive ranging from 500 to 75,000 ppm on the oldest, most magnetic, most metal ladened 10–20% portion of equilibrium catalyst.

To better understand how metal accumulates on a catalyst, whether as a contaminant metal, or a magnetic susceptibility enhancing agent, "magnetic hook", FIG. 1 shows a typical example of how much catalyst of a given day's addition remains in the unit as time goes by, and if 5% of the total catalyst inventory is removed or lost each day. In this case, note that half of the initial charge from day 1 is gone after about 13 days, but 1/5 of the charge is still present after 30 days and 1/10 still present after 50 days. For 1% addition rate, ½ of the initial charge is still present after 40 days. FIG. 2 demonstrates that the entire inventory has the same age distribution. Because some of these particles have a long residence time in the unit of at least 60 days and even longer, metal continues to increase ever more rapidly on a single particle as time goes by. FIG. 3 is shown as an example for a case where additive, or nickel contaminant, accumulate on one million pounds of catalyst inventory, being replaced at a daily rate of 5%, for a 40,000 B/D unit operating on a residual feedstock. Note that 20 percent of the catalyst in this example has greater than 10,000 ppm (metal or additive which is reached in about 30 days). Obviously, the shape of these curves will vary with replacement rate, metal in feed, and catalyst inventory. But it should be apparent that the metal contaminant level should rise dramatically and the activity drop precipitously as it reaches about the 50–60% level of day 1 catalyst removal level. It is here where contaminant level rises rapidly and individual particles with these high levels need to be removed quickly and selectively. By the same token, additive level starts to rise rapidly, thereby increasing magnetic susceptibility and making removal much easier.

Background of Earlier Patent Applications on Magnetic Hooks

Although iron, and especially in the superparamagnetic form, and manganese have been shown to be a very effective "magnetic hook" additives, a recent search for still other effective "magnetic hooks" has uncovered a family of additives, namely, certain members of the "heavy" rare earths, including, gadolinium, terbium, dysprosium, holmium, erbium, and thulium, which are uniquely effective, and which perform in a manner distinguishable from iron and manganese.

Because of traditional industrial experience in catalytic cracking and the undesirable reputation iron received as it impacted on earlier fluid catalytic cracking systems, it is still shunned by many operating personnel. This conceptual resistance to its application has caused us to seek other equally effective and less controversial magnetic susceptibility additives (magnetic hooks) where iron in any form is considered unacceptable. Also, in some cases, where all metal including iron, nickel, or vanadium are assiduously prevented from reaching the catalyst, or where feedstocks are free of metals entirely, or nearly so, a further improvement in our previous methods of separation is still desired. This is because even in such cases, it is still desirable to develop and further improve a process to selectively remove old, inactive catalyst from new, in order to minimize uneconomical, poor selectivity thermal reactions which tend to take place on old, inactive catalyst, even in the absence of contaminating metal.

Another qualification sought in a preferred "magnetic hook" additive is that it be inexpensive so that the cost of the additive does not offset the profit gains from magnetic separation. It should also be readily available, and have no other adverse catalytic effects. On the contrary, it should also preferably possess still other attractive catalytic properties.

The rare earth metal elements, especially some of the heavy rare earth elements, are all known for their relatively high paramagnetic susceptibilities. This property is due to the presence of unpaired and outer orbital protected 4f shell electrons. This strong paramagnetic property is unusually high for the six elements mentioned and reaches a maximum at dysprosium and holmium, with terbium, erbium and thulium being close in value and gadolinium also possessing good properties. See FIG. 4 and Table 1. All of these presumably might be considered good candidates for "magnetic hook" exploitation.

TABLE 1

| | Mag Suscept.[1] One Gram Formula Wt. of Oxide $Xg \times 10^{-6}$ emu/gm | Mag Suscept. One Gram of Metal $Xg \times 10^{-6}$ emu/gm | Mag Suscept. 0.01 Gram of Metal $Xg \times 10^{-6}$ emu/gm |
|---|---|---|---|
| Light Rare Earths | | | |
| Praeseodymium oxide | 9,000 | 32 | 0.32 |
| Neodymium oxide | 10,200 | 35 | 0.35 |
| Heavy Rare Earths | | | |
| Europium oxide | 10,100 | 33 | 0.33 |
| Gadolinum oxide | 53,200 | 168 | 1.68 |
| Terbium oxide | 78,340 | 246 | 2.46 |
| Dysprosium oxide | 89,600 | 275 | 2.75 |
| Dysprosium oxide | 89,600 | 275 | 2.75 |
| Holmium oxide | 88,100 | 267 | 2.67 |
| Erbium oxide | 73,920 | 221 | 2.21 |
| Thulium oxide | 51,440 | 152 | 1.52 |

[1]Handbook of Chemistry and Physics, 57th Edition, CRC Press

DESCRIPTION OF THE INVENTION

This invention relates to the discovery that several heavy rare earths, namely, gadolinium, erbium, and thulium, more preferably terbium and holmium, and most preferably, dysprosium, from a technical standpoint, all elements with good paramagnetic properties, can be used in place of iron and manganese as "magnetic hooks", enabling removal of old cracking catalyst from new by continuous addition. From a cost and availability standpoint, terbium, holmium, and thulium, are preferred, gadolinium and erbium are more preferred, and dysprosium, most preferred.

It is also shown that these elements raise the cracking activity of catalyst and enhance cracking selectivity as well. They not only increase activity and gasoline yield, but surprisingly, lower $H_2$ and coke make even below untreated catalyst, thus further increasing their unique value as "magnetic hooks". They also are more resistant to deactivation as shown by the high level of activity remaining after steaming for 24 hours at 1425° F. The heavy rare earths are now discovered to be excellent candidates for "magnetic hook" application. The transition elements have excellent paramagnetic properties because of the presence of their unpaired d-shell electrons. However, these d-shell electrons are not buried very deeply in the electron cloud surrounding iron and manganese, and hence, can be easily interacted with other elements which couple with them, causing them to lose magnetic properties.

The heavy rare earths, on the other hand, gain this property from f-shell electrons, which are buried more deeply in the electron cloud surrounding the atom, and cannot easily be interacted with, thus making them more stable as paramagnetic elements. In other words, the f-shell electrons retain their paramagnetic properties under much more severe magnetic neutralization conditions.

While the heavy rare earths have these magnetically and catalytically desirable properties, some of them do have other undesirable limitations of price and/or availability in reasonable quantities. Terbium is presently very expensive and holmium and thulium are not readily available in pure form, although all of these heavy rare earths may be utilized as a mixture in unpurified form, which when utilized as magnetic hooks, may make even the more expensive or less readily available elements economically acceptable.

On the other hand, gadolinium, dysprosium, and erbium are readily available and relatively inexpensive. Therefore, based on a weighted combination of magnetic properties, price and availability, erbium and gadolinium are more preferred, and dysprosium is most preferred. This invention, however, is not to be considered limited on the basis of price or availability of any one element.

Consideration was also given to utilizing the so-called light rare earths, which are more readily available and less expensive. However, cerium and lanthanium have very little paramagnetic properties, and as shown in Table 1 praseodymium and neodymium have only a very modest magnetic susceptibility, which would be ineffective for use as "magnetic hooks".

BRIEF DESCRIPTION OF THE DRAWING

FIG. 14 represents the environment of a commercial regenerator. Dysprosium magnetic hook; (Example 5), 20% FOC-90 with 6500 ppm dysprosium mixed with 80% FOC-90 calcined two hours in air 1200° F.

EXAMPLE 1

Figure 1:
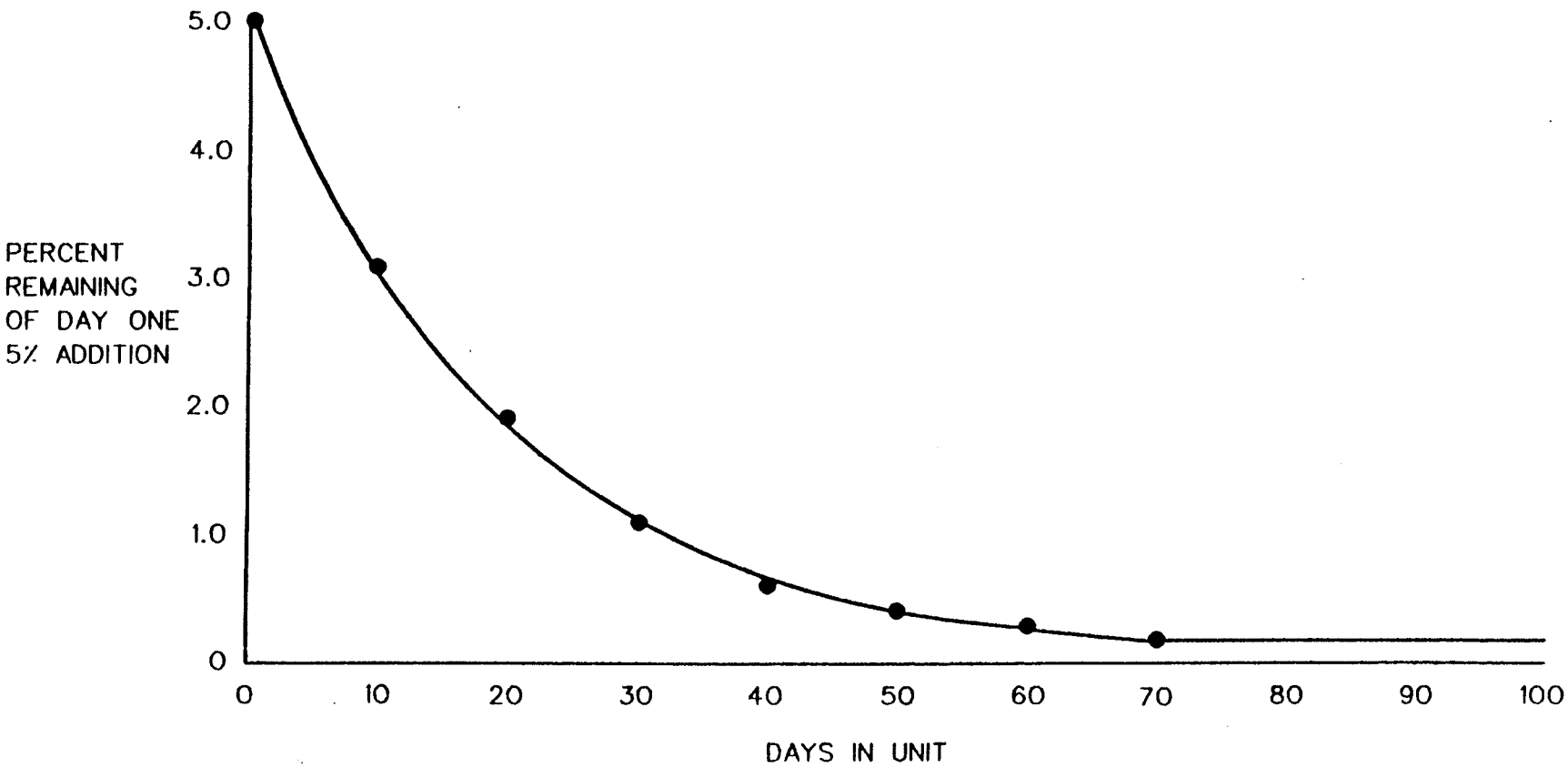
FIG. 1 is a plot of the percent remaining of the first day's addition (5% of catalyst inventory) versus the number of days that the catalyst has been in the hydrocarbon conversion unit. This shows that some of the old catalyst stays in the unit nearly forever 5% catalyst replacement, 1 million pound catalyst inventory, 40,000 B/D feed rate of reduced crude, 10 ppm rare earth in feed.
Figure 2:
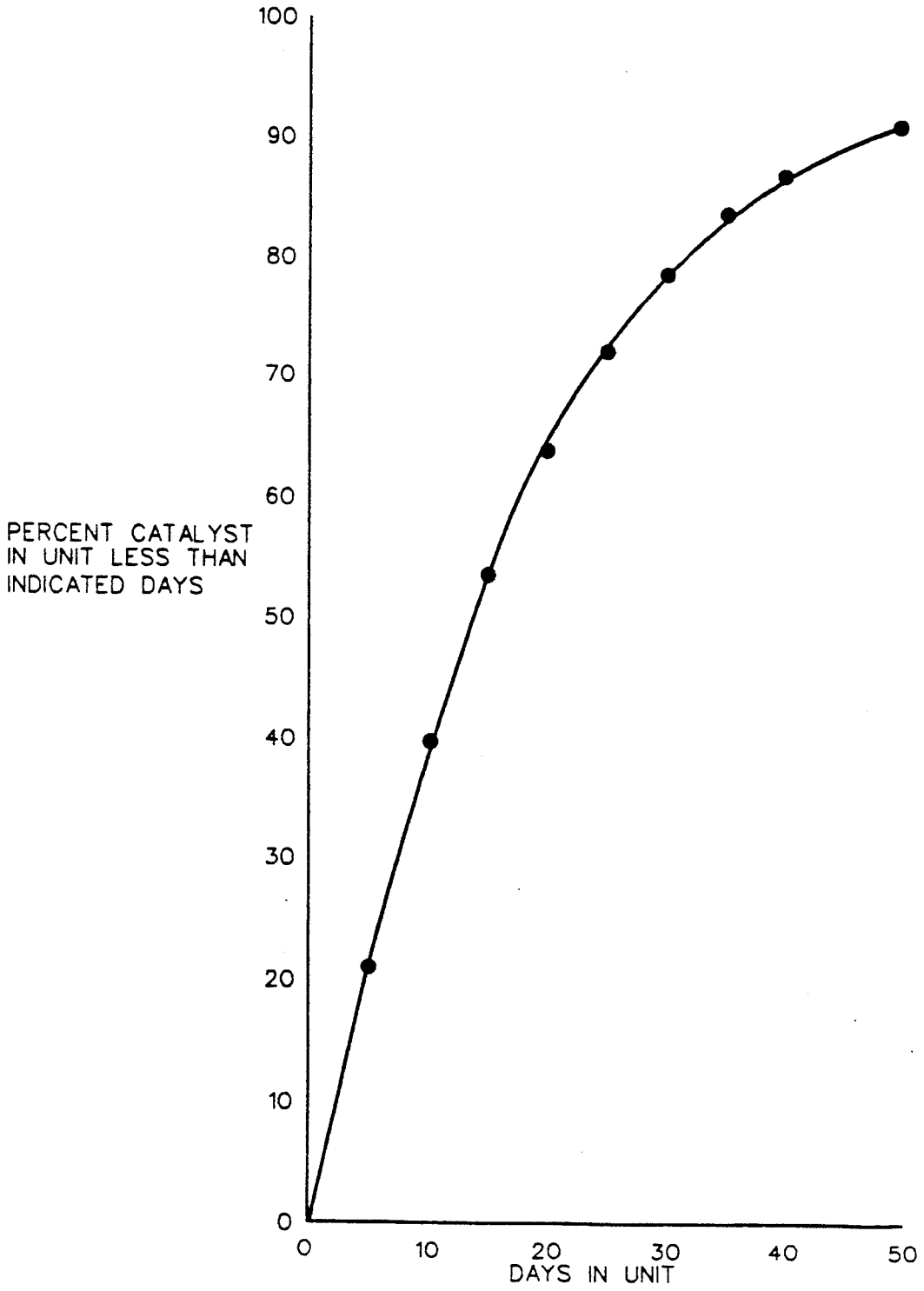
FIG. 2 is a cumulative plot of catalyst age versus days in unit, showing that e.g. after five days, 20% of the catalyst is less than five days old, etc. Percent of catalyst in unit less than indicated days 5% daily replacement, 1 million pound catalyst inventory, 40,000 barrels a day.

Preparation of Heavy Rare Earth Containing Magnetically Promoted Catalysts

In seeking to determine whether the heavy rare earth metals with high magnetic properties when deposited on a catalyst surface would have effective magnetic susceptibility values to enable separation of old catalyst with high level of additive from new catalyst with low additive content, while at the same time showing acceptable catalytic properties, the following impregnation experiments were performed: 100 gms. of a typical commercial, cracking catalyst was slurried with 150 ml. of $H_2O$. A solution of a specific salt of each of the transition metals under consideration, namely praseodymium, neodymium, gadolinium, terbium, dysprosium, holmium, erbium, and thulium, was prepared by dissolving a suitable amount of the water-soluble salt in 50 ml. of water. Each solution was heated to boiling to assure complete solution and then rapidly mixed with the catalyst slurry to achieve absorption and adsorption of the metal on the catalyst surface. This mixture was allowed to remain in contact for 12 hours at room temperature, with intermittent shaking to insure good contact. After standing for 12 hours, the catalyst slurry was dewatered on a filter and the filter cake recovered. The filter cake was oven dried, calcined at 1200° F. for four hours and allowed to cool. A sample was taken for metal analysis, and a second sample for measurement of magnetic susceptibility and catalyst activity and selectivity.

Compounds employed in this study are listed in Table 2:

TABLE 2

| |
|---|
| Praseodymium III acetate hydrate |
| Neodymium chloride 6 $H_2O$ |
| Gadolinium III acetate hydrate |

TABLE 2-continued

| |
|---|
| Terbium III acetate hydrate |
| Dysprosium III acetate hydrate |
| Holmium III nitrate |
| Erbium III nitrate |
| Thulium III nitrate |

Each of these salts was evaluated as received for magnetic susceptibility on a Johnson Mathey Magnetic Susceptibility Balance and had the values shown in Table 3, which agree quite well with literature values.

TABLE 3

| | Salt $Xg \times 10^{-6}$ emu/gm/ | As 100% Metal $Xg \times 10^{-6}$ emu/gm. |
|---|---|---|
| Praseodymium III acetate hydrate | 16.3 | 36.9 |
| Neodymium chloride 6 $H_2O$ | 14.0 | 39.3 |
| Gadolinium III acetate hydrate | 63.7 | 135.6 |
| Terbium III acetate hydrate | 106.8 | 226.0 |
| Dysprosium III acetate hydrate | 117.9 | 246.4 |
| Holmium III nitrate | 114.7 | 306.7 |
| Erbium III nitrate | 90.3 | 239.5 |
| Thulium III nitrate | 55.6 | 146.5 |

The chemical analyses for all of these impregnations are shown in Table 4 and the increase in metal content shown in Table 4-A was used to determine the magnetic susceptibility contribution from all of these added elements, Table 4-B. The results show that on the catalyst surface, when used to enhance magnetic separation that holmium is the most effective of the elements, closely followed by dysprosium and terbium and erbium. Even gadolinium and thulium are reasonably effective compared with neodymium and praseodymium.

TABLE 4-A

MAGNETIC SUSCEPTIBILITY SENSITIVITY VALUES

| Rare Earth Element | Total Chemical Analysis ppm | Virgin Chemical Analysis ppm | Actual Incr. Chemical Analysis ppm |
|---|---|---|---|
| Praseodymium | 8,700 | 800 | 7,900 |
| Neodymium | 9,200 | 1,800 | 7,400 |
| Gadolinium | 7,267 | <75 | 7,200 |
| Terbium | 7,000 | <75 | 7,000 |
| Dysprosium | 7,300 | <75 | 7,300 |
| Holmium | 7,100 | <75 | 7,100 |
| Erbium | 6,400 | <75 | 6,400 |
| Thulium | 6.560 | <75 | 6,500 |

TABLE 4-B

MAGNETIC SUSCEPTIBILITY SENSITIVITY VALUES
Magnetic Susceptibility $\times 10^{-6}$ emu/gm.

| | Total Catalyst | Virgin Catalyst | Element Contribution Due to Diff. | 1% Level | 100% Level |
|---|---|---|---|---|---|
| Praseodymium | 1.33 | 1.20 | 0.13 | 0.16 | 16 |
| Neodymium | 1.64 | 1.20 | 0.44 | 0.59 | 59 |
| Gadolinium | 2.54 | 1.20 | 1.34 | 1.86 | 186 |
| Terbium | 3.23 | 1.20 | 2.03 | 2.90 | 290 |
| Dysprosium | 3.44 | 1.20 | 2.24 | 3.06 | 306 |
| Holmium | 3.56 | 1.20 | 2.36 | 3.32 | 332 |
| Erbium | 3.07 | 1.20 | 1.87 | 2.90 | 290 |
| Thulium | 2.23 | 1.20 | 1.23 | 1.89 | 189 |
| Commercial Catalyst Support | — | 1.20 | — | — | — |

These data demonstrate that when a catalyst is impregnated with one of these heavy rare earths, that the paramagnetic properties reported in the literature for a pure compound of the element, can be expected to demonstrate the same paramagnetic properties when utilized in this invention.

Table 5 compares the values reported for these elements in the Handbook of Chemistry and Physics with values determined on the Johnson-Mathey Balance for the pure salts used in impregnation, and for the final impregnated catalysts, all at the 100% metal level. Considering the possible variations in metal analysis for the difficulty analyzable heavy rare earths, the potential slight variations in measurement possible for the literature values, there is remarkable agreement.

TABLE 5

Comparative Paramagnetic Properties of the Light and Heavy Rare Earths

| | Magnetic Susceptibility $\times 10^{-6}$ emu/gm | | |
|---|---|---|---|
| | Metal on Catalyst | Metal in Pure Cmpds. | Literature Values |
| Neodymium | 16 | 39 | 35 |
| Praseodymium | 59 | 37 | 32 |
| Gadolinium | 186 | 136 | 168 |
| Terbium | 290 | 226 | 246 |
| Dysprosium | 306 | 246 | 275 |
| Holmium | 332 | 307 | 267 |
| Erbium | 290 | 239 | 221 |
| Thulium | 189 | 147 | 152 |

These values confirmed that use of the heavy rare earths can be relied upon to serve as magnetic hooks for used cracking catalysts.

Figure 5:
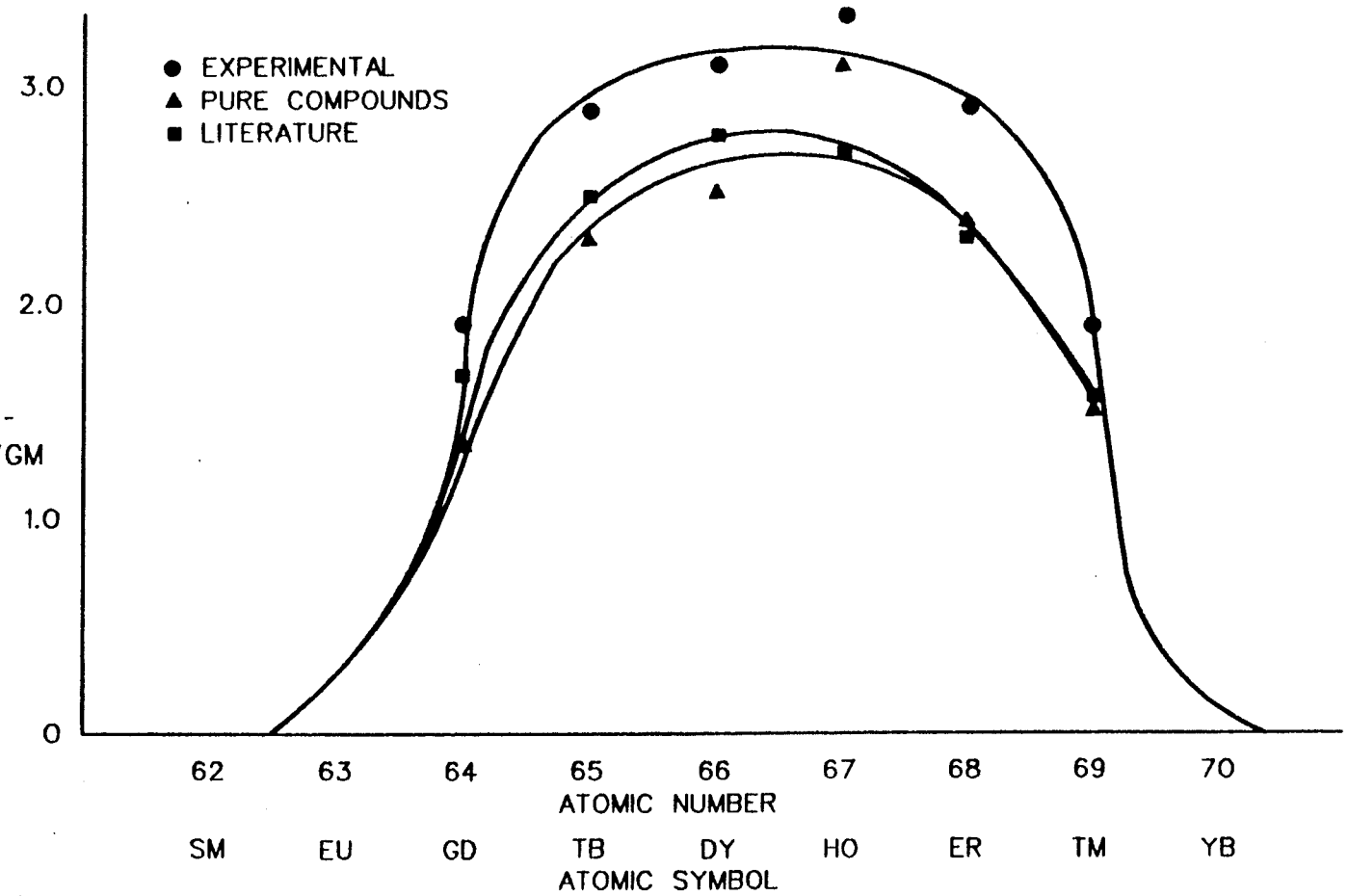
FIG. 5 is a plot of magnetic susceptibility (1% metal on catalyst) versus atomic number for the same heavy rare earths as in FIG. 4, plotting experimental, pure compound and literature values, confirming the validity of the Johnson-Mathey Balance measurements and showing that rare earths on catalysts give the same paramagnetic susceptibility values as do the pure compounds.

FIG. 5 shows this incremental increase in magnetic susceptibility for a 1% impregnation of rare earth on catalyst, and when compared with 1% values for these same elements, as measured in the pure compounds, or as reported in the literature, show remarkably good agreement when considering the limitations of the experiments, the potential slight variation in composition of the pure compounds, or the uncertainties of heavy rare earth analysis, which is quite difficult below 1%, and/or methods by which the literature values were obtained. It strongly confirms that the 4f-shell electrons are sufficiently isolated so that they present the same paramagnetic values whether deposited as individual ions on a large catalyst surface, incorporated in a complex chemical, or bound in an inactive oxide. These results establish that the heavy rare earths are suitable for "magnetic hook" utilization. Heavy rare earths resist interaction with 4f-shell electrons and thereby reduce paramagnetism, an advantage over the transition elements. For example, antimony pentoxide has been used as a poison for nickel to reduce the dehydrogenation and coking tendency of nickel. It does this by presumably interacting with 3d-shell electrons. This not only deactivates nickel, but would cause it to lose or reduce its paramagnetic properties, thereby diminishing the magnetic separation capability. The same would be true for iron, and for iron or manganese added as "magnetic hooks". In those cases where antimony is used as a coke and hydrogen reducing agent, the use of the heavy rare earths additive would then be preferred over manganese or iron for enhancing separation, and this data confirms heavy rare earth paramagnetic stability in the presence of many different environments.

EXAMPLE 2

Catalytic Properties of Heavy Rare Earth "Magnetic Hook" Promoted Catalyst

Although the heavy rare earths were shown to be magnetically effective "magnetic hook" elements, it was also necessary to determine the relative catalytic behavior of these elements. It has been known for a long time in the art that the light rare earths (cerium, lanthanum, neodymium, and praseodymium) can increase the activity of zeolite promoted catalysts and light rare earths. Light rare earth promoted zeolite containing catalysts have been in use since about 1964. However, for various reasons unknown to the inventor but previously demonstrated to the benefits or other outstanding possible attributes, the rare earths have not, to our knowledge, been used or promoted, including cost and availability, as well as no greater effectiveness in commercial fluid cracking catalysts, except for where they may be present as a minor contaminant. It may also be that our preferred method of treatment (additive addition) has resulted in a catalyst with unusual properties. For these reasons, it was required that catalysts impregnated with these paramagnetic promoting elements be evaluated for their effect on catalyst properties.

In order to become a suitable candidate, the additive had to meet the requirement of reasonable cost and availability, have good effective paramagnetic properties, be shown to have no adverse effect on catalyst performance, to be as effective or more so than iron, and/or manganese. Any other properties giving them competitive or superior performance, such as for example, resistance to deactivation when exposed to antimony pentoxide, or resistance to any other additives which affect magnetic properties, or is combined with the catalyst to achieve other objectives, such as coke burning aids, vanadium immobilizers or traps, $SO_3$ transfer aid, or oxidation inhibitors, to name a few. In such use the heavy rare earths are preferred because of the effectiveness of 4f-shell protection.

To determine the impact of these additives on catalytic behavior, each of the catalyst samples in Example 1 was submitted for catalytic cracking microactivity testing (MAT test). Each of these samples was calcined for four hours at 1200° F. in air prior to testing. In addition, in order to more closely simulate operating conditions, each sample was steamed at 1425° F. for 24 hours prior to testing. The results of testing these samples are shown in Table 6.

The results in Table 6 show dramatically that even at a relatively low level of heavy rare earth addition (6,500–7,300 ppm) compared to commercial catalysts, and even in this base catalyst, which itself contains 1,500 ppm of cerium, 5,100 ppm of lanthanum, 620 ppm of praseodymium, and 1,800 ppm of neodymium (total 8,920 ppm), that activity, and resistance to steaming were greatly enhanced. On a relative activity basis (See U.S. Pat. No. 4,406,773) the promoted catalyst relative activities ranged from 95 to as high as 140 and 155, values over two times the 63 value for the base catalyst.

TABLE 6

MAT Results on FOC-90 with Various Rare Earths
Steaming Conditions: 1425 F.; 24 hours
MAT Conditions: 4.5 Cat/Oil; 906 F. Rx Temp; 32 WHSV

| Fraction | Base FOC-90 | FOC-90 Dysprosium | FOC-90 Erbium | FOC-90 Gadolinium | FOC-90 Holmium |
|---|---|---|---|---|---|
| Conversion, V % | 70.57 | 75.18 | 77.83 | 74.38 | 78.75 |
| Conversion, W % | 68.83 | 73.31 | 75.87 | 72.48 | 76.87 |
| Relative Activity | 63 | 100 | 140 | 95 | 155 |
| Yields, W % | | | | | |
| C2 & lighter | 1.18 | 1.20 | 1.49 | 1.20 | 1.30 |
| Hydrogen | 0.08 | 0.06 | 0.05 | 0.05 | 0.04 |
| Coke | 3.58 | 3.69 | 4.40 | 4.04 | 4.98 |
| Total C3's | 4.13 | 4.27 | 5.16 | 4.50 | 4.79 |
| Propane | 0.59 | 0.71 | 1.12 | 0.76 | 0.98 |
| Propylene | 3.54 | 3.56 | 4.04 | 3.73 | 3.81 |
| Total C4's | 8.87 | 9.21 | 10.79 | 9.68 | 10.35 |
| IC4 | 3.68 | 4.27 | 5.36 | 4.39 | 5.15 |
| NC4 | 0.59 | 0.75 | 1.15 | 0.82 | 1.04 |
| Butenes | 4.60 | 4.18 | 4.28 | 4.46 | 4.16 |
| Gasoline | 51.09 | 54.94 | 54.02 | 53.07 | 55.45 |
| LCO | 22.66 | 20.07 | 17.35 | 19.64 | 17.19 |
| CSO | 8.50 | 6.63 | 6.78 | 7.88 | 5.94 |
| Yields, V % | | | | | |
| Total C3's | 7.11 | 7.37 | 8.92 | 7.76 | 8.27 |
| C3 Olefins | 6.08 | 6.12 | 6.93 | 6.41 | 6.54 |
| Total C4's | 13.51 | 14.09 | 16.58 | 14.80 | 15.89 |
| IC4 | 5.86 | 6.80 | 8.53 | 6.99 | 8.19 |
| C4 Olefins | 6.75 | 6.14 | 6.28 | 6.56 | 6.10 |
| Gasoline | 61.90 | 66.56 | 65.45 | 64.29 | 67.18 |
| LCO | 22.08 | 19.19 | 16.46 | 18.89 | 16.26 |
| CSO | 7.35 | 5.63 | 5.71 | 6.73 | 4.99 |
| Coke Factor | 1.62 | 1.34 | 1.40 | 1.53 | 1.50 |

Rare earth promoted catalysts are also noted for their ability to transfer hydrogen to olefins, thus keeping $H_2$ make lower, and olefins in gasoline reduced. Reduced olefins promise to be of importance in reformulated gasoline, thus the heavy rare earths providing an additional beneficial property for magnetic hook promoted catalysts. Both low $H_2$ and low gas make are also desirable properties of a preferred catalyst. In Table 7 is shown the ratio of hydrogen make for these heavy rare earth promoted catalysts compared to the base case.

TABLE 7

| Ratio $H_2$ to Base Case $H_2$ | |
|---|---|
| Base Case | 1.00 |
| Dysprosium | 0.66 |
| Erbium | 0.625 |
| Gadolinium | 0.625 |
| Holmium | 0.500 |

Note that in all cases, hydrogen production decreases, even when conversion increased.

TABLE 8

| Ratio of Base Case Coke to Promoted Catalysts | |
|---|---|
| Base Case | 1.000 |
| Dysprosium | 0.827 |
| Erbium | 0.864 |
| Gadolinium | 0.944 |
| Holmium | 0.925 |

In Table 8 the heavy rare earths also produced much less coke than did the base case again showing the benefit of using these heavy rare earths as magnetic enhancing additives.

The results demonstrate that in addition to their exceptional magnetic behavior and their use as "magnetic hooks", the heavy rare earths demonstrate an ability to enhance activity, provide more resistance to deactivation than the base catalyst while at the same time reducing hydrogen and coke make.

EXAMPLE 3

Figure 6:
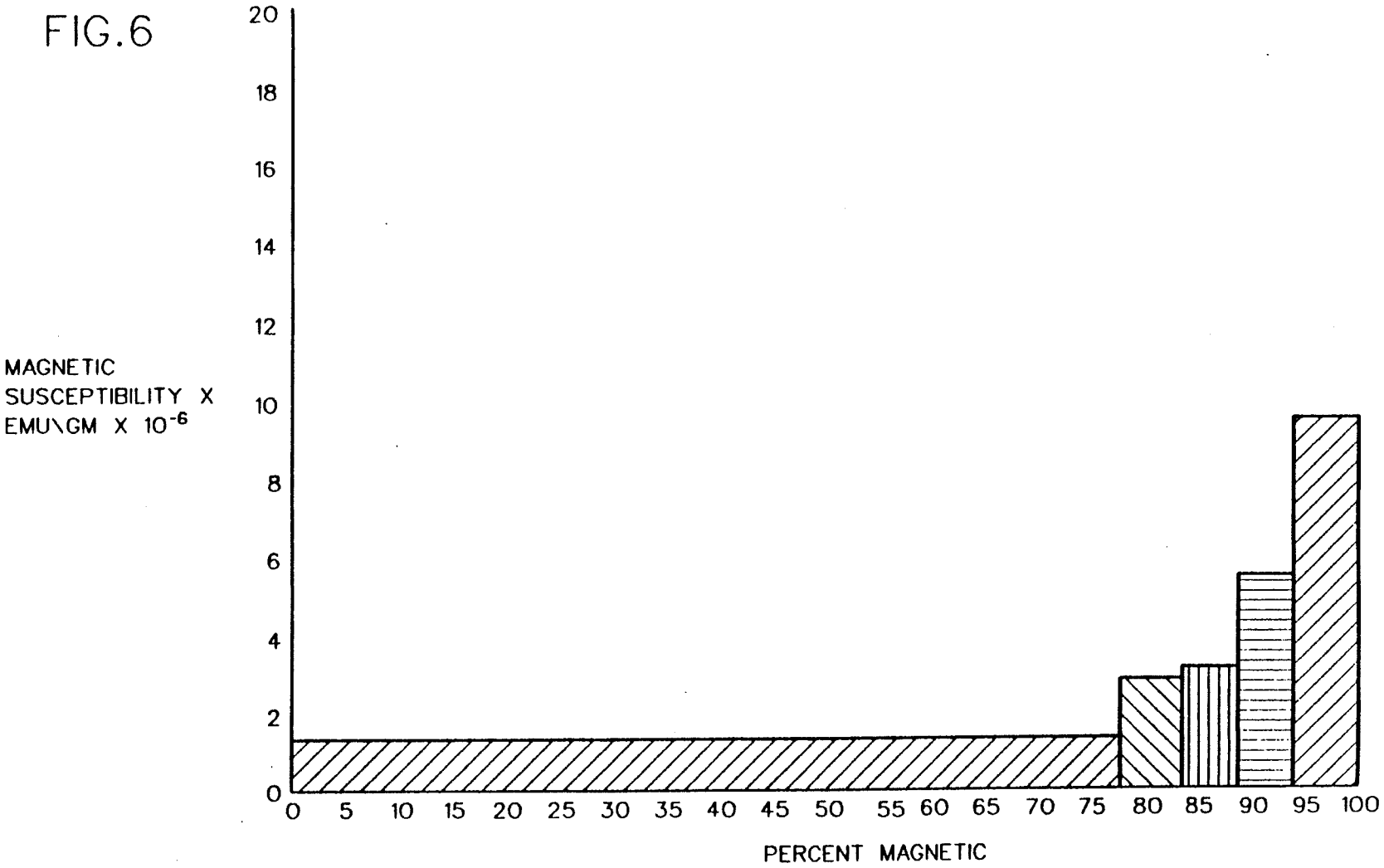
FIG. 6 is a plot of magnetic susceptibility versus magnetic fractions (percent) showing the magnetic susceptibility of successive cuts from a sample of of commercial FOC-90 catalyst containing 7,200 ppm by weight gadolinium, which is mixed with 80% catalyst not loaded with rare earth. This figure demonstrates the effectiveness of gadolinium as a magnetic hook, even though its atomic number is only 64, lowest of the six lower heavy rare earths (see FIGS. 4 and 5). Gadolinum-magnetic hook; 20% FOC-90 7200 ppm gadolinium mixed with 80% FOC-90.
Figure 7:
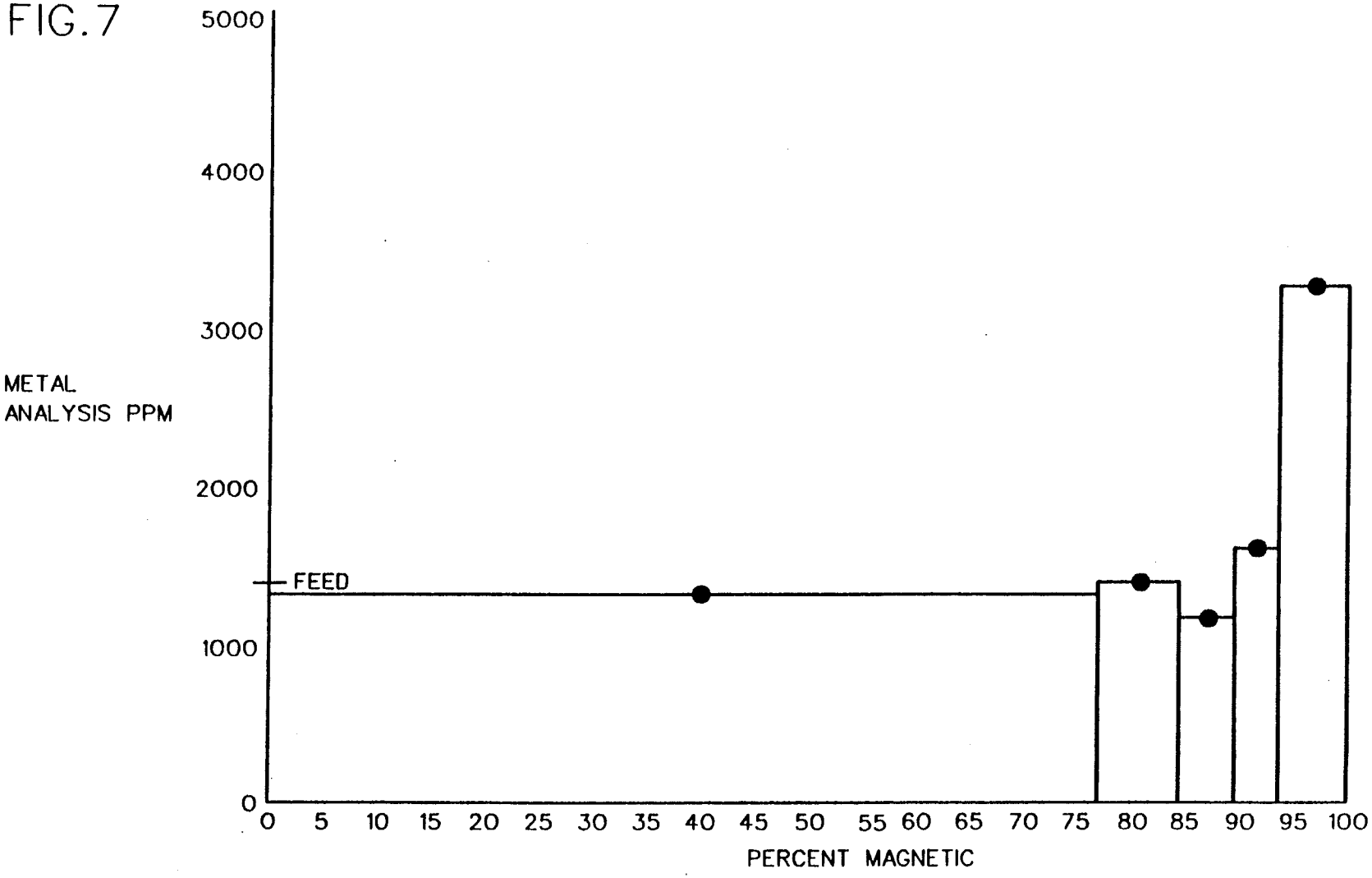
FIG. 7 is a plot of metal on catalyst (ppm) versus percent magnetic for the same sample used in FIG. 6. This confirms that the most magnetic fraction is also the most metal-contaminated.

Use of the Heavy Rare Earths as Fluid Cracking Catalyst "Magnetic Hooks". Simulation of Reactor Inert Gas Conditions To demonstrate the ability of the heavy rare earths to perform as "magnetic hooks", the following experiments were performed. 20 grams of heavy rare earth impregnated catalyst containing either 7,200 ppm of gadolinium, 7,300 ppm of dysprosium, 7,100 ppm of holmium, or 6,400 ppm of erbium, as shown in Table 4-A was mixed intimately with 80 gms. of virgin catalyst. Each mixture was calcined at 1200° F. in nitrogen for two hours, cooled, and subjected to magnetic separation on a Permroll rare earth roller magnetic separator (RERMS), manufactured by Ore Sorters, Corp. The sample was split into five fractions of increasing magnetic strength. Tables 9, 10, 11, and 12 show the wt. % of the various cuts, the heavy rare earth with chemical analysis, and the magnetic properties of each fraction. Table 9 and FIG. 6 show magnetic susceptibility plotted versus percent magnetic for gadolinium, and FIG. 7 shows gadolinium chemical analysis versus magnetic percent. As can be seen, gadolinium was very effective in providing a "magnetic hook" by which to achieve separation.

Figure 8:
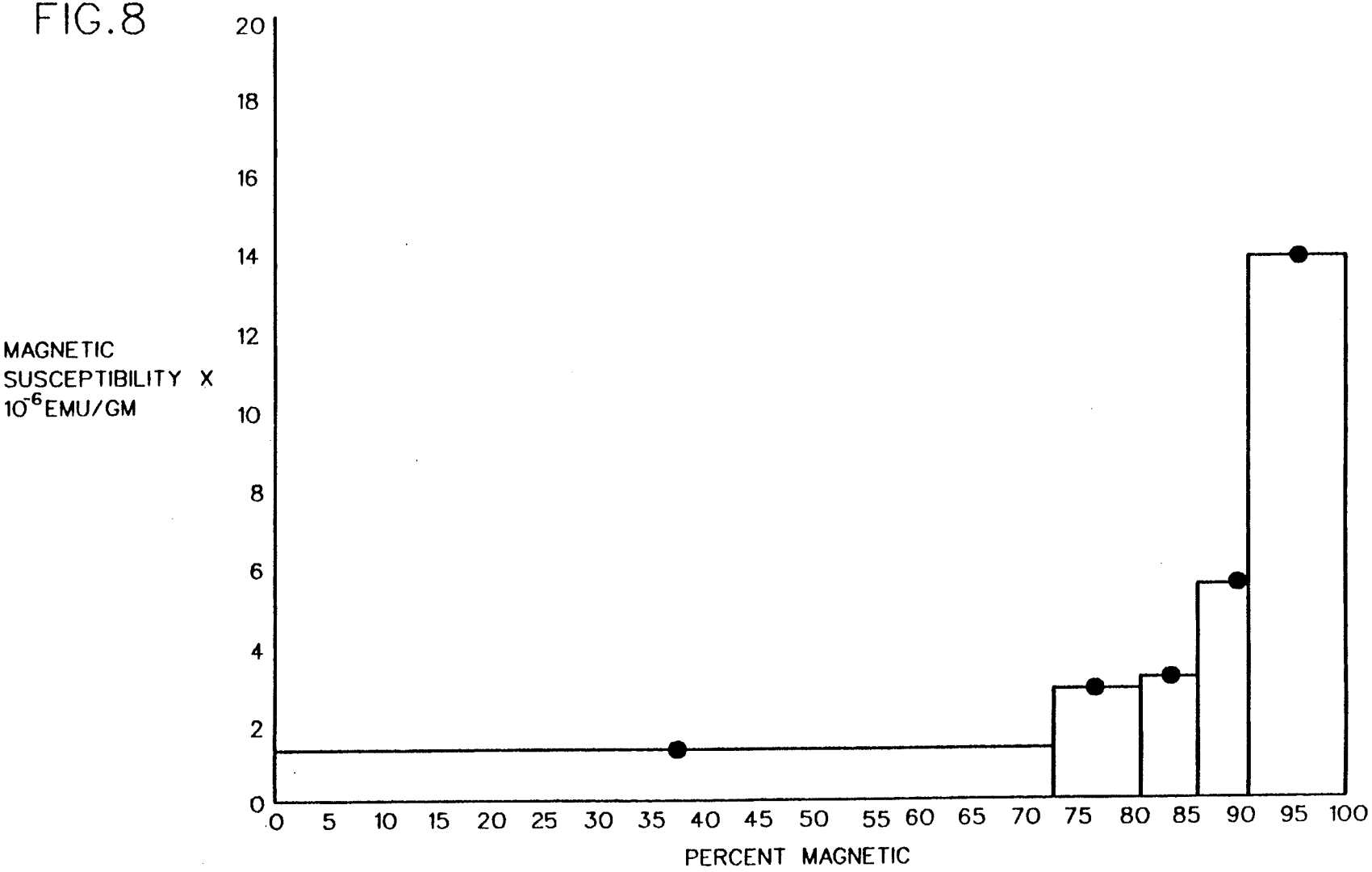
FIG. 8 is a plot analogous to FIG. 6 but substituting dysprosium as the rare earth. Gadolinium magnetic hook; 20% FOC-90, 7200 ppm gadolinium. Dysprosium magnetic hook; 20% FOC-90, 7200 ppm dysprosium plus 80% FOC-90.
Figure 9:
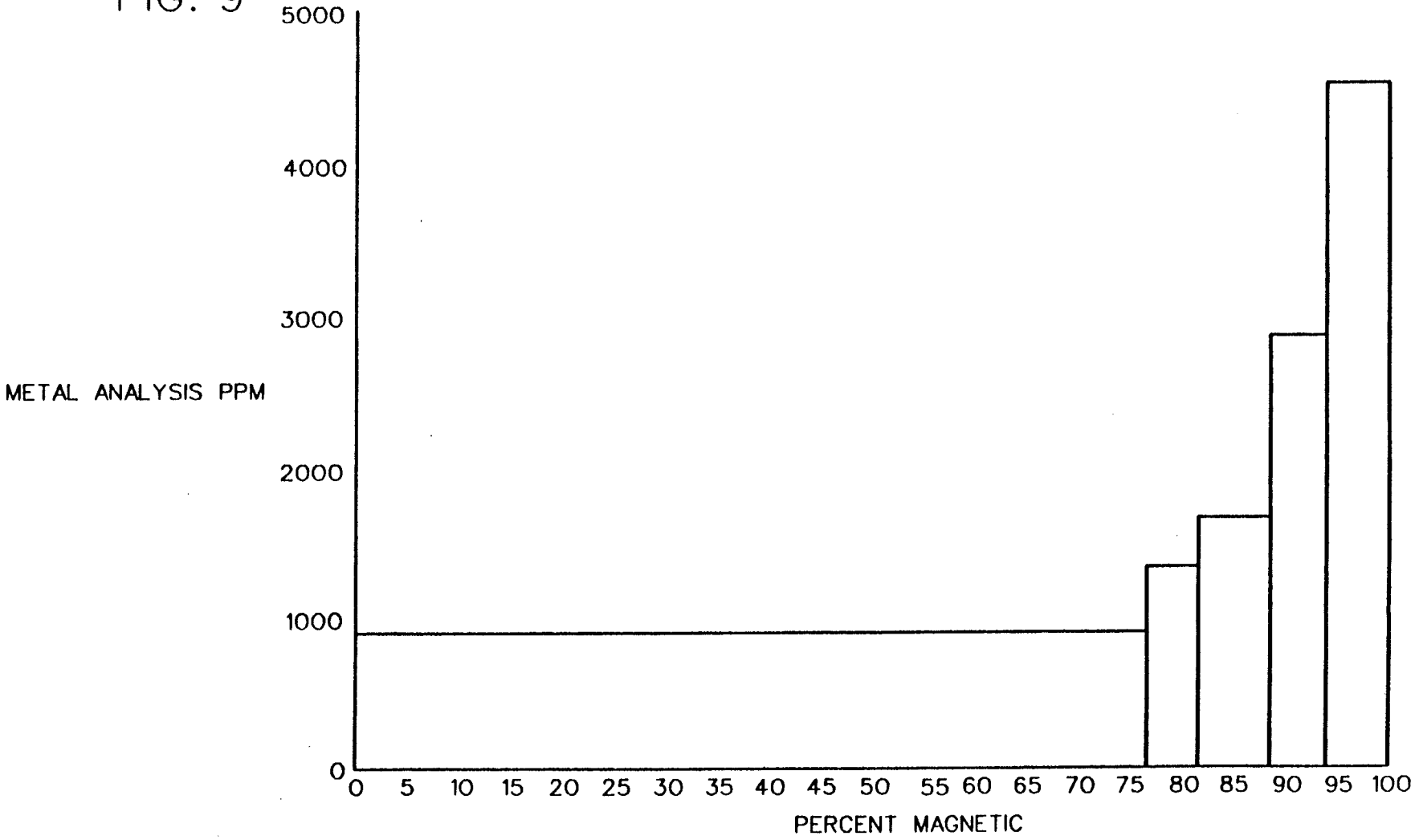
FIG. 9 is a plot analogous to FIG. 7 but substituting dysprosium as the rare earth, again confirming that the most magnetic fraction is also the most metal-contaminated. Dysprosium magnetic hook; 20% FOC-90, 7200 ppm dysprosium mixed with 80% FOC-90.
Figure 10:
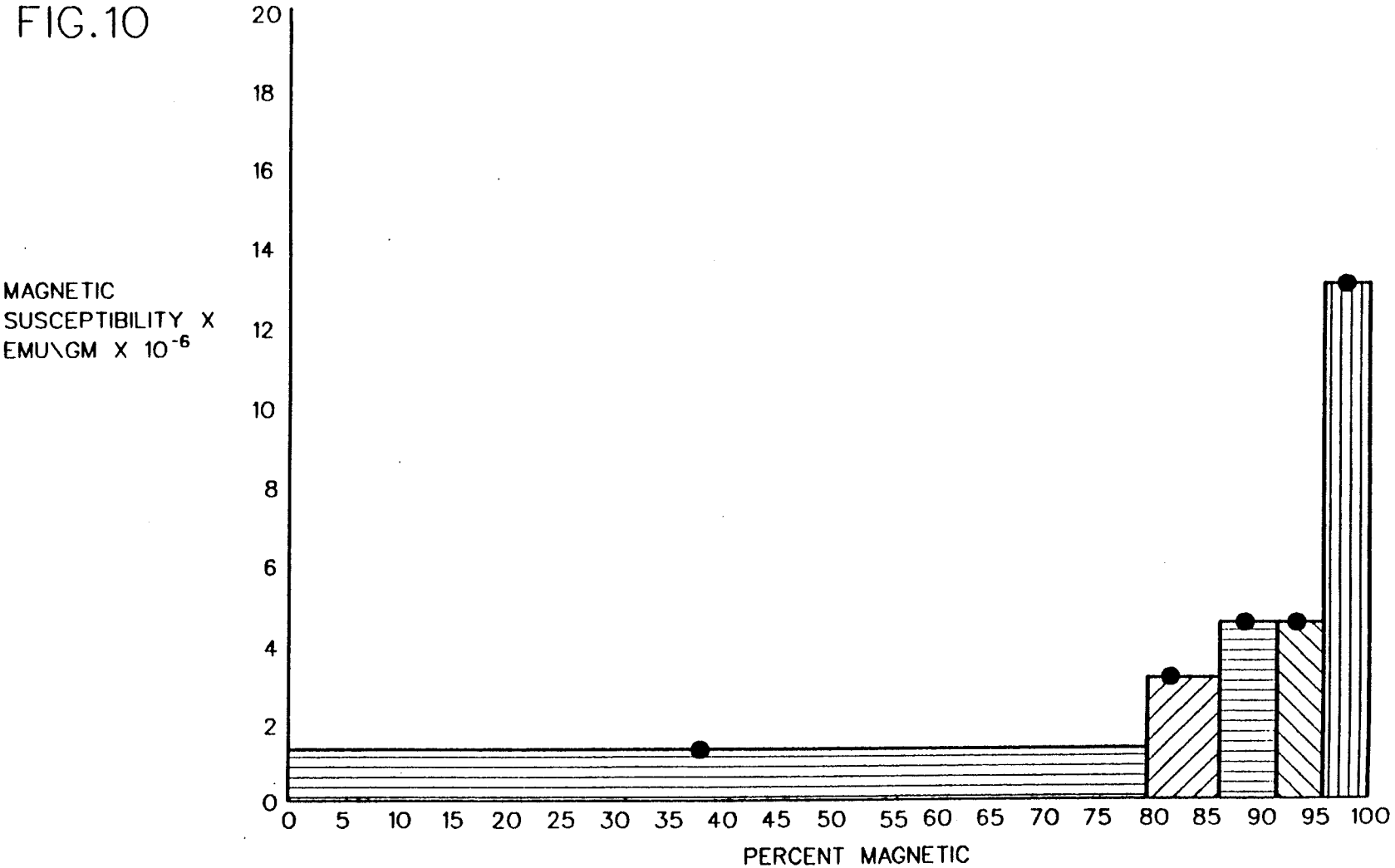
FIG. 10 is a plot analogous to FIG. 6 but substituting holmium as the rare earth. Holmium magnetic hook; 20% FOC-90 plus 7100 ppm holmium mixed with 80% FOC-90.
Figure 11:
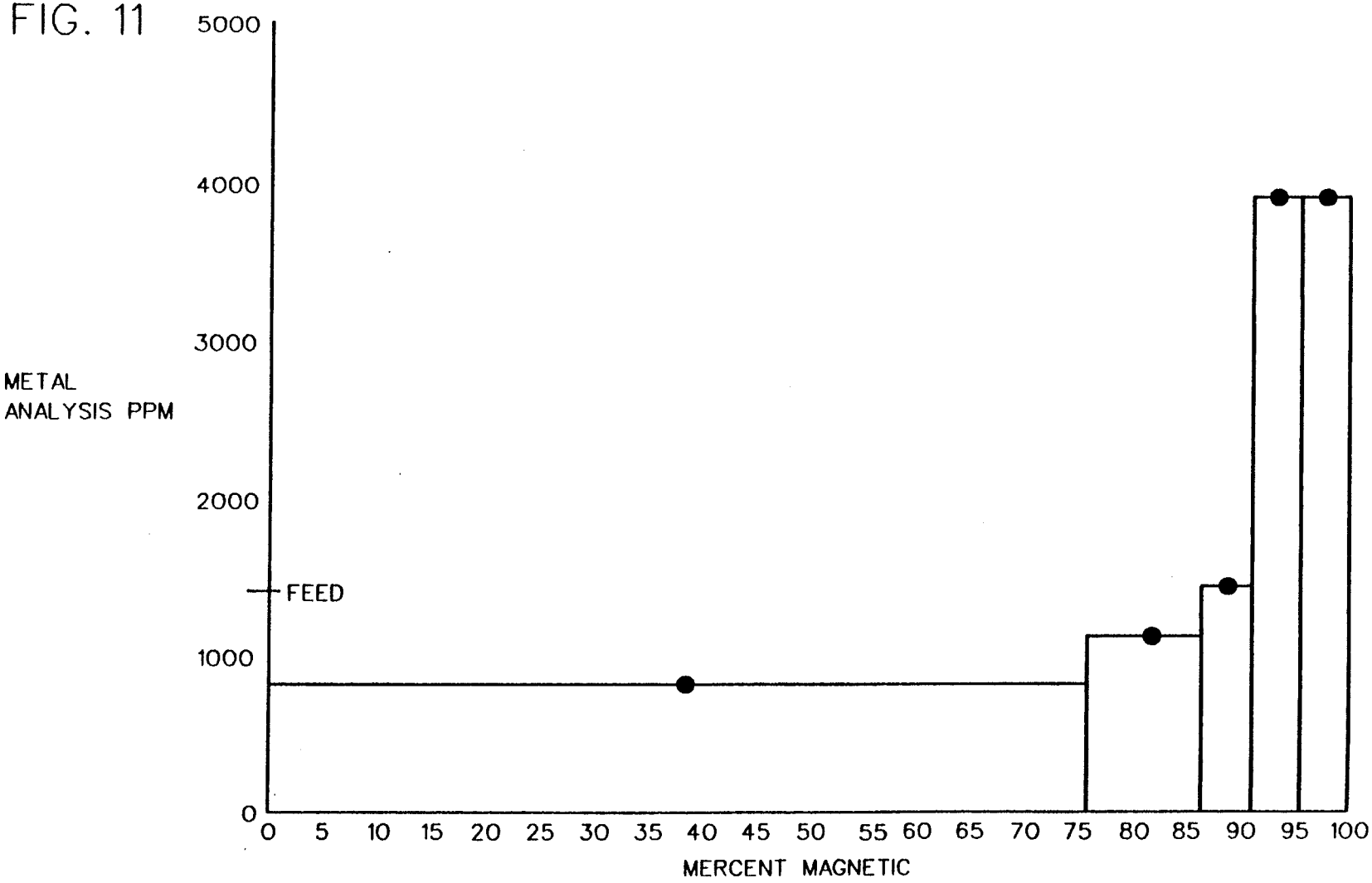
FIG. 11 is a plot analogous to FIG. 7 but substituting holmium as the rare earth, again confirming that the most magnetic fraction is also the most metal-contaminated and confirming the effectiveness of the heavy rare earth magnetic hooks. Holmium magnetic hook; 20% FOC-90 7100 ppm holmium mixed with 80% FOC-90.
Figure 12:
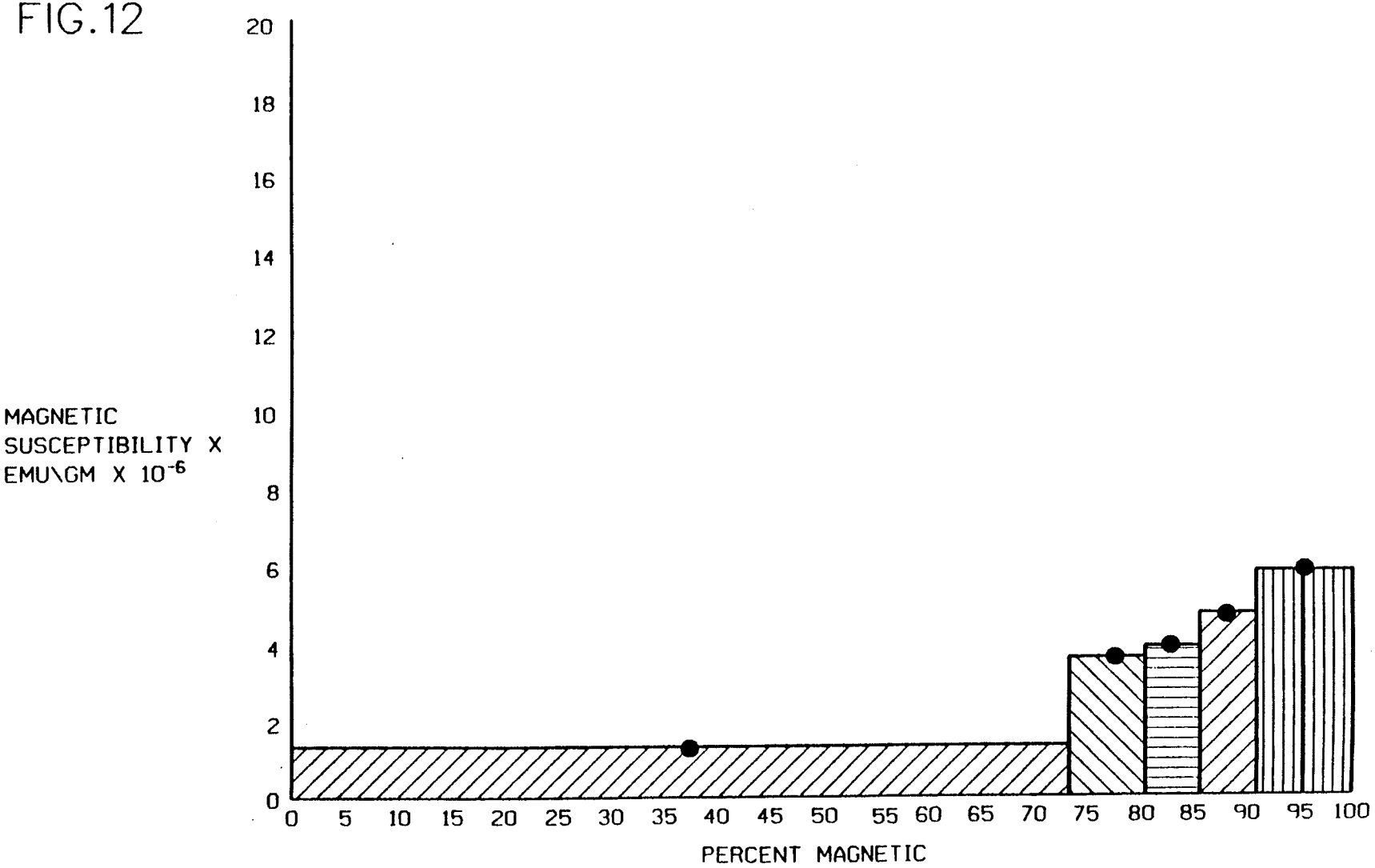
FIG. 12 is a plot analogous to FIG. 6 but substituting erbium as the rare earth magnetic hook. Erbium magnetic hook; 20% FOC-90 plus 6400 ppm erbium mixed with 80% FOC-90.
Figure 13:
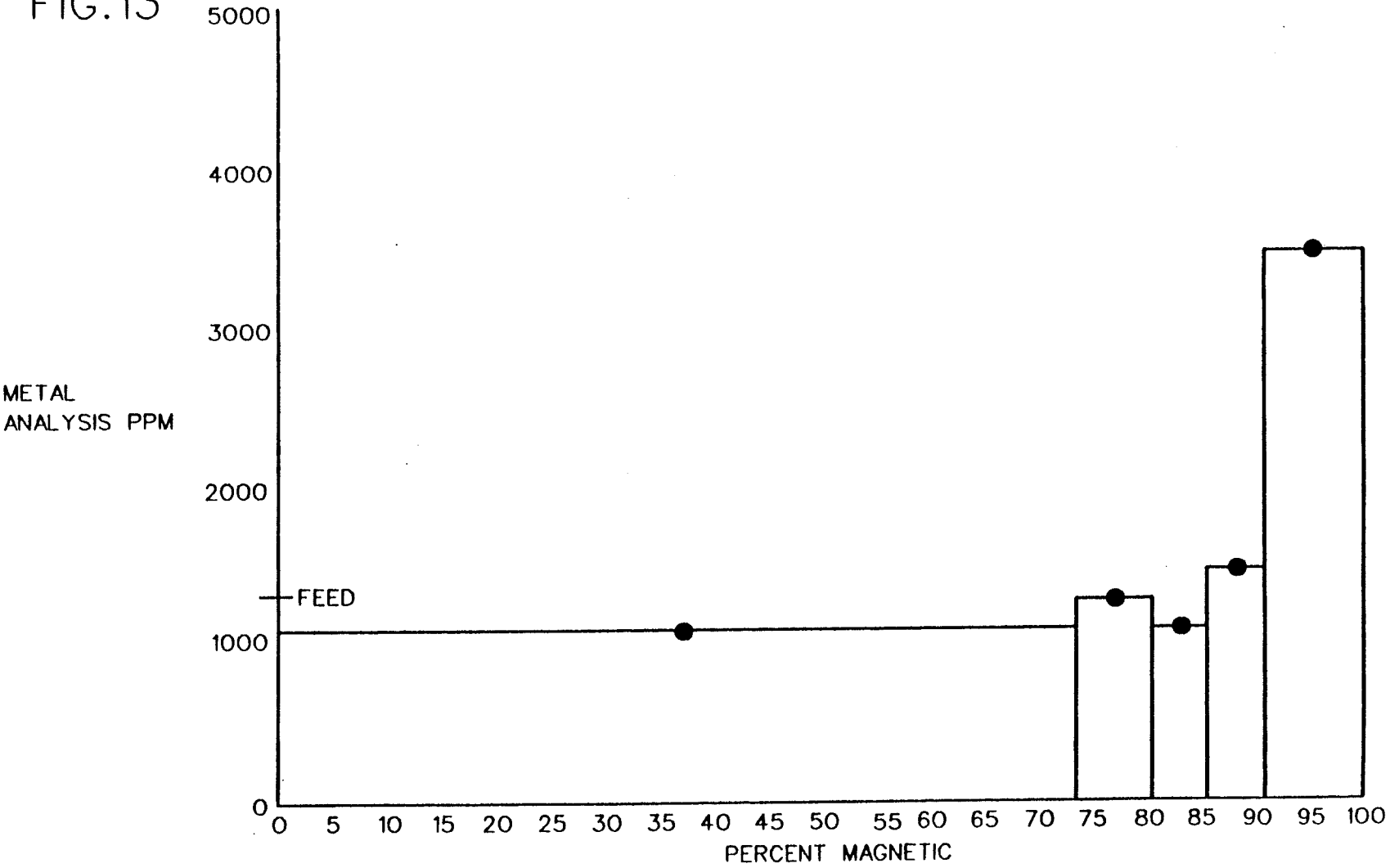
FIG. 13 is a plot analogous to FIG. 7 but substituting erbium as the rare earth magnetic hook, again confirming that the most magnetic fraction is also the most metal-contaminated. Erbium magnetic hook; 20% FOC-90 plus 6400 ppm erbium mixed with 80% FOC-90.

Table 10 shows the chemical analysis and FIGS. 8 and 9 show similar behavior for dysprosium. Tables 11 and 12 and FIGS. 10, 11, 12, and 13 show similar results for holmium and erbium respectively. The data all show, therefore, that when the heavy rare earths are utilized simply or in combination as an additive in continuous or cyclic addition, they can also be used to establish the catalyst age of individual particles in the unit. But more importantly, they are very effective in facilitating separation of old catalyst from new.

TABLE 9

Gadolinium Addition
20% catalyst with 7,200 ppm gadolinium
80% catalyst - no additive
Nitrogen 1200° F. - two hours

| Cut # | Wt. % Mag. Fractions | Iron ppm | Gadolinium ppm | Mag. Suscept. $Xg \times 10^{-6}$ emu/gm. |
|---|---|---|---|---|
| 1 | 6.7 | 4,300 | 1,400 | 9.4 |
| 2 | 3.6 | 4,124 | 1,200 | 5.5 |
| 3 | 4.6 | 4,124 | 1,600 | 2.9 |
| 4 | 7.2 | 4,050 | 3,300 | 2.7 |
| 5 | 77.9 | 3,980 | 1,310 | 1.4 |

TABLE 10

Dysprosium Addition
20% catalyst with 7,300 ppm dysprosium
80% catalyst - no additive
Nitrogen 1200° F. - two hours

| Cut # | Wt. % Mag. Fractions | Iron ppm | Dysprosium ppm | Mag. Suscept. $Xg \times 10^{-6}$ emu/gm. |
|---|---|---|---|---|
| 1 | 9.1 | 4,400 | 1,300 | 13.8 |
| 2 | 5.0 | 4,124 | 1,600 | 4.4 |
| 3 | 5.2 | 4,334 | 2,80 | 3.1 |
| 4 | 7.2 | 4,264 | 4,200 | 3.3 |
| 5 | 73.6 | 4,334 | 950 | 1.6 |

TABLE 11

Holmium Addition
20% catalyst with 7,100 ppm holmium
80% catalyst - no additive
Nitrogen 1200° F. - two hours

| Cut # | Wt. % Mag. Fractions | Iron ppm | Holmium ppm | Mag. Suscept. $Xg \times 10^{-6}$ emu/gm. |
|---|---|---|---|---|
| 1 | 5.5 | 4,400 | 1,100 | 12.6 |
| 2 | 3.2 | 405 | 1,400 | 4.4 |
| 3 | 4.4 | 4,264 | 3,800 | 4.4 |
| 4 | 10.1 | 4,194 | 3,800 | 3.5 |
| 5 | 76.8 | 4,194 | 800 | 1.6 |

TABLE 12

Erbium Addition
20% catalyst with 6,400 ppm erbium
80% catalyst - no additive
Nitrogen 1200° F. - two hours

| Cut # | Wt. % Mag. Fractions | Iron ppm | Holmium ppm | Mag. Suscept. $Xg \times 10^{-6}$ emu/gm. |
|---|---|---|---|---|
| 1 | 9.1 | 4,404 | 1,200 | 5.7 |
| 2 | 5.0 | 4,333 | 1,100 | 4.6 |
| 3 | 5.2 | 4,194 | 1,400 | 3.6 |
| 4 | 7.2 | 4,264 | 3,400 | 3.3 |
| 5 | 73.6 | 4,264 | 1,100 | 1.6 |

It should also be noted in each table and figure that part of the magnetic susceptibility increase is undoubtedly due to a trace amount of superparamagnetic iron material in a very small portion of the most magnetic material between 96 and 100% of percent magnetic in spite of the smaller amount of less active iron present in all of the samples. The data do show and demonstrate how the heavy rare earths can amplify and enhance magnetic separation as a "magnetic hook", and can even augment, supplant, and further enhance magnetic separation in those cases where iron is added as a "magnetic hook". Here the heavy rare earths can also be added in combination of one or more and also as an additional and complimentary additive. This invention, therefore, also includes adding a combination of one or more heavy rare earths with iron and manganese additives, as well as with one or more heavy rare earths individually.

EXAMPLE 4

Operating Process

Figure 20:
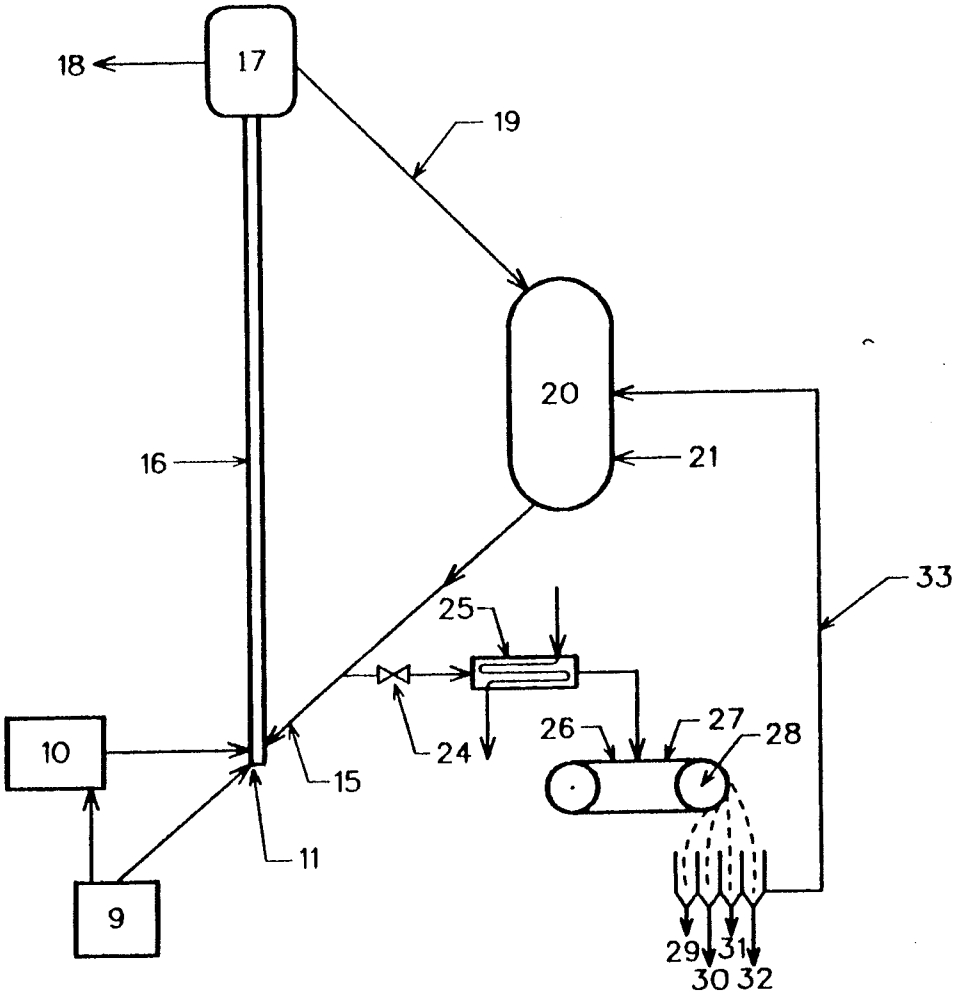
FIG. 20 is a schematic diagram of a commercial hydrocarbon conversion unit showing apparatus for contacting metal-contaminated hydrocarbon feed to which rare earth hooks 9 may be either added directly or added instead to the riser reactor zone 16 where the catalyst contacts the hydrocarbon feed and is separated from the products in separators 17 which returns catalyst to the regenerator for removal of carbon contaminates and recycle to the riser 16. A portion of the recycling regenerated catalyst is directed to the magnetic roller-belt separator 27 where it is separated into fractions with the most magnetic fraction 29 being discarded and the least magnetic fraction 32 being recycled back to the regenerator. The cooler is not required where a catalyst can be allowed to cool by natural convection, e.g. in a spent catalyst storage bin. The operation is similar when sorbent is substituted for catalyst.

FIG. 20 shows one example of how the process employing this technology is utilized. Reduced crude bottoms containing about 0.5 to 100 ppm Ni+vanadium derived from distilling off a portion of crude oil 10 enters the riser reactor 11. In the riser this reduced crude contacts regenerated catalyst returning from the regenerator line 15 and travels up the riser 16 cracking the reduced crude and generating product 18 and spent catalyst 17 which is contaminated with coke and metals from the reduced crude. The spent catalyst 17 enters the regenerator 20 via line 19 and is oxidized with air 21 to burn off coke and thereby regenerate the catalyst for return to the riser 16. Total catalyst inventory 0.5 to 20, more preferably 0.8 to 15 and most preferably about 1 to 10% of catalyst is withdrawn, depending on metal content of feed. Here about 8% of the regenerated catalyst is diverted through line 24 to catalyst cooler 25 and to feed to magnetic separator 26, where it falls onto belt 27, moves past roller 28, a high intensity rare earth-containing permanent magnetic roller which splits the catalyst into two or more portions 29 to 32. The more magnetic (more metal-contaminated) and more "magnetic hook" promoted portions, e.g. 29, and/or 29 & 30 are rejected for chemical reclaiming, metals recovery, or disposal. The less magnetic (less metal-contaminated) portions 31 and/or 31 and 32 travel through line 33 back to the regenerator 20. One or more heavy rare earth additives (9) are either added in amounts of 0.1 to 100 ppm to the feedstock in an organic solvent or water at 10 or on the catalyst at the bottom of the riser 11 prior to catalyst contact with oil.

EXAMPLE 5

Use of Heavy Rare Earths as a Fluid Cracking Catalyst "Magnetic Hook". Simulating Regenerator Conditions Two more experiments to demonstrate how a heavy rare earth "magnetic hook" functions are similar to those in example 3, but differed in that the catalyst, either 20 wt. % of catalyst which contained 7,300 ppm of dysprosium or 7,100 ppm of holmium deposited on a catalyst base, mixed with 80% non-promoted catalyst and were calcined in air to simulate regenerator conditions. In example 3, a catalyst mixture of 20 wt. % rare earth-promoted catalyst was combined with 80 wt. % non-impregnated catalyst to simulate and demonstrate how magnetic separation can be achieved.

It was calcined in $N_2$. Because of the presence of a small amount of carbon in this catalyst, calcination in $N_2$ tends to create a reducing atmosphere which increases the magnetic contribution of natural iron existing in virgin catalyst, and hence, magnetic susceptibility. This more resembles conditions found in the regenerator.

Figure 14:
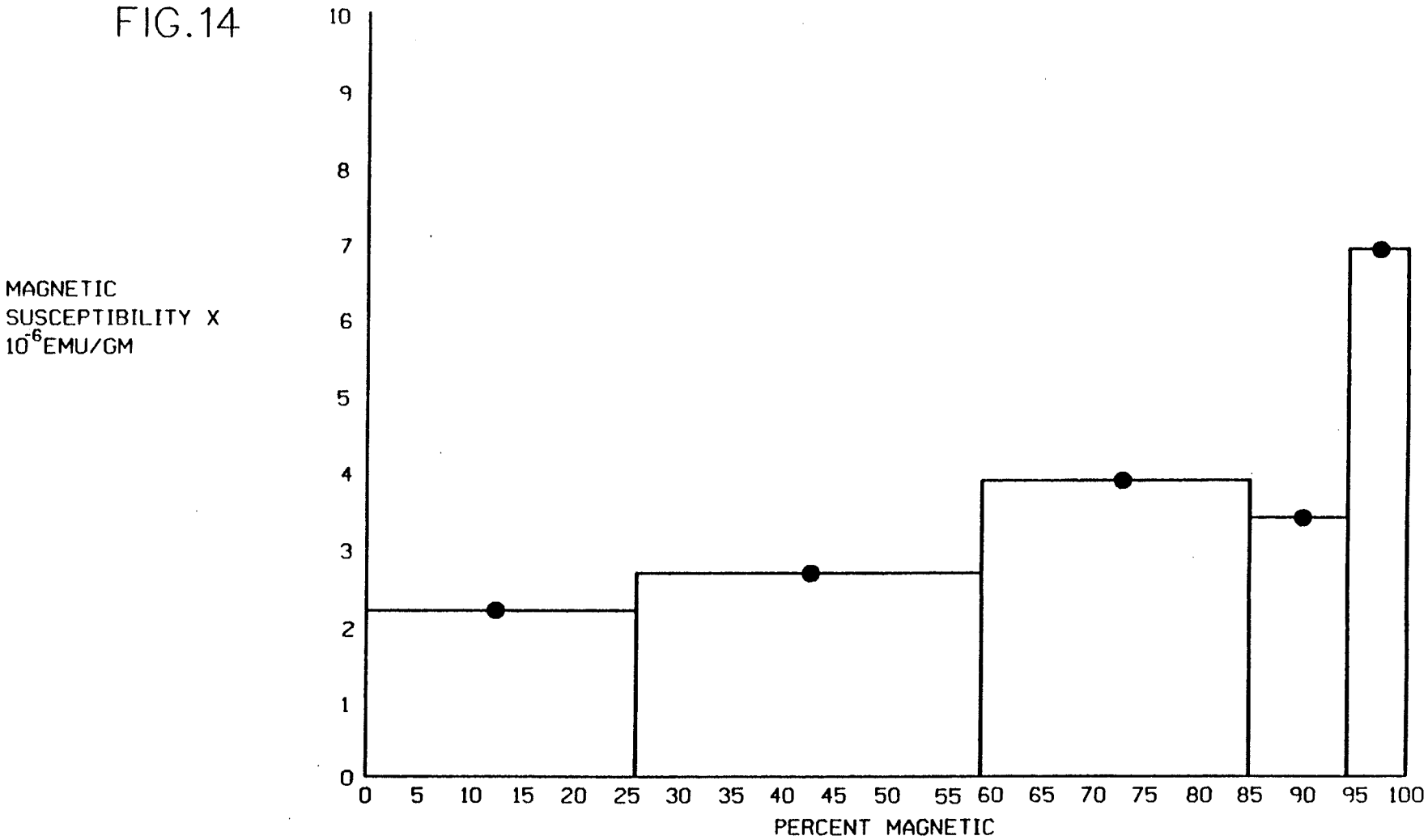
FIG. 14 is a plot of magnetic susceptibility versus percent magnetic, substituting dysprosium as the rare earth magnetic hook but also calcining two hours at 1200° F. in air, contrasted with FIG. 8 where the catalyst was calcined in nitrogen. This
Figure 15:
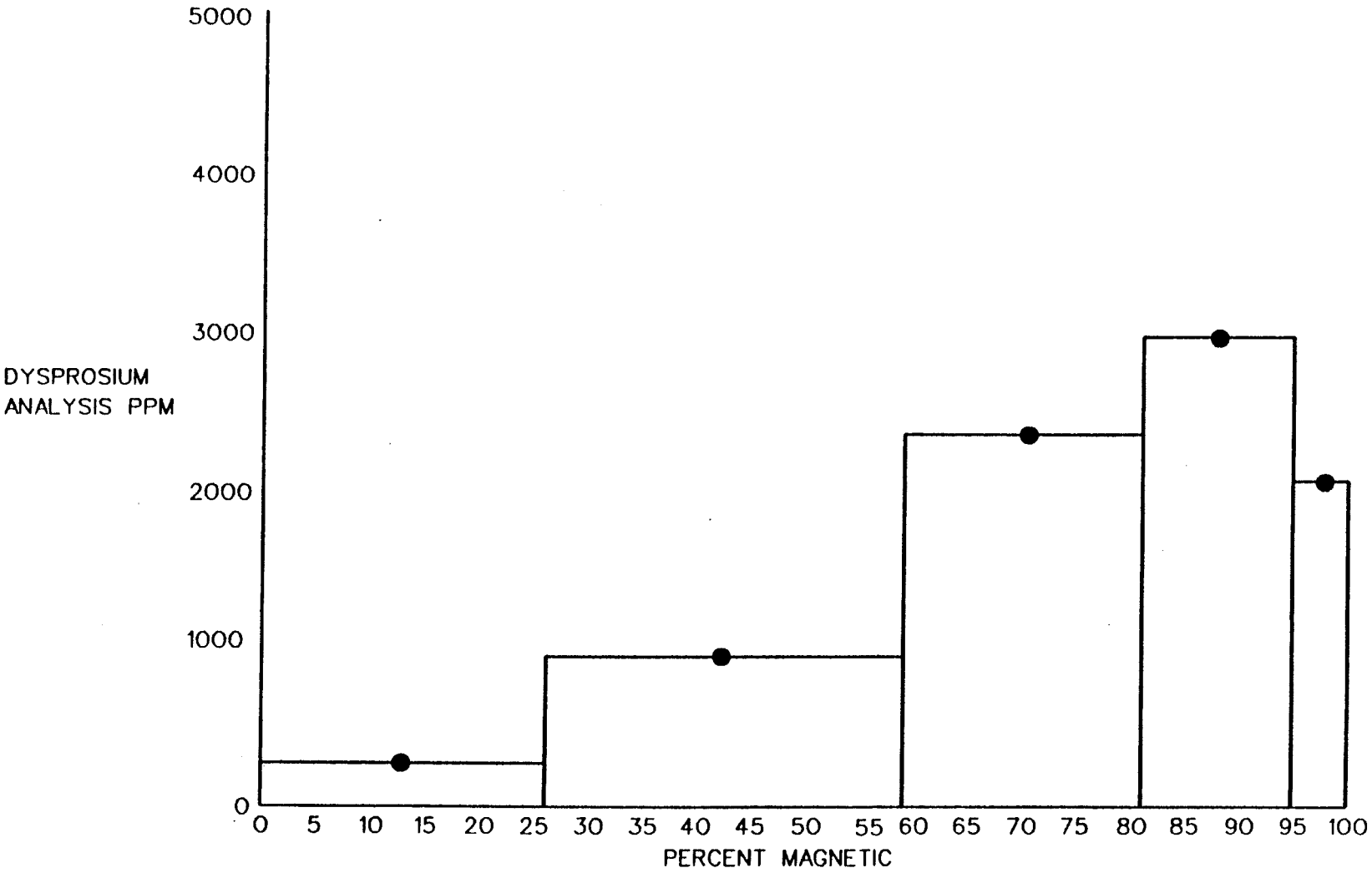
FIG. 15 is a plot of dysprosium content (ppm) versus percent magnetic showing that rare earth content correlates (approximately) with percent removed in a magnetic separation accomplished on a roller-belt magnet as described in U.S. Ser. No. 332,079 filed Apr. 3, 1989. Dysprosium magnetic hook; 20% FOC-90 plus 6500 ppm dysprosium.

In this case, these two mixtures were also subjected to magnetic separation on a rare earth roller magnetic separator (RERMS) and were also split into five fractions. However, in this case, larger size cuts were made so that a clearer distinction could be made as to the effectiveness of the manganese "magnetic hook", and they were calcined in air for two hours at 1200° F. to simulate regenerator conditions. Table 13 shows the wt. % of the various cuts for dysprosium, with cut #1 being the most magnetic and cut #5 the least magnetic. Also shown is the magnetic susceptibilities and chemical analysis of these fractions. This data is plotted in FIGS. 14 and 15 respectively, and again demonstrates the effectiveness of the heavy rare earths in facilitating separation.

Figure 16:
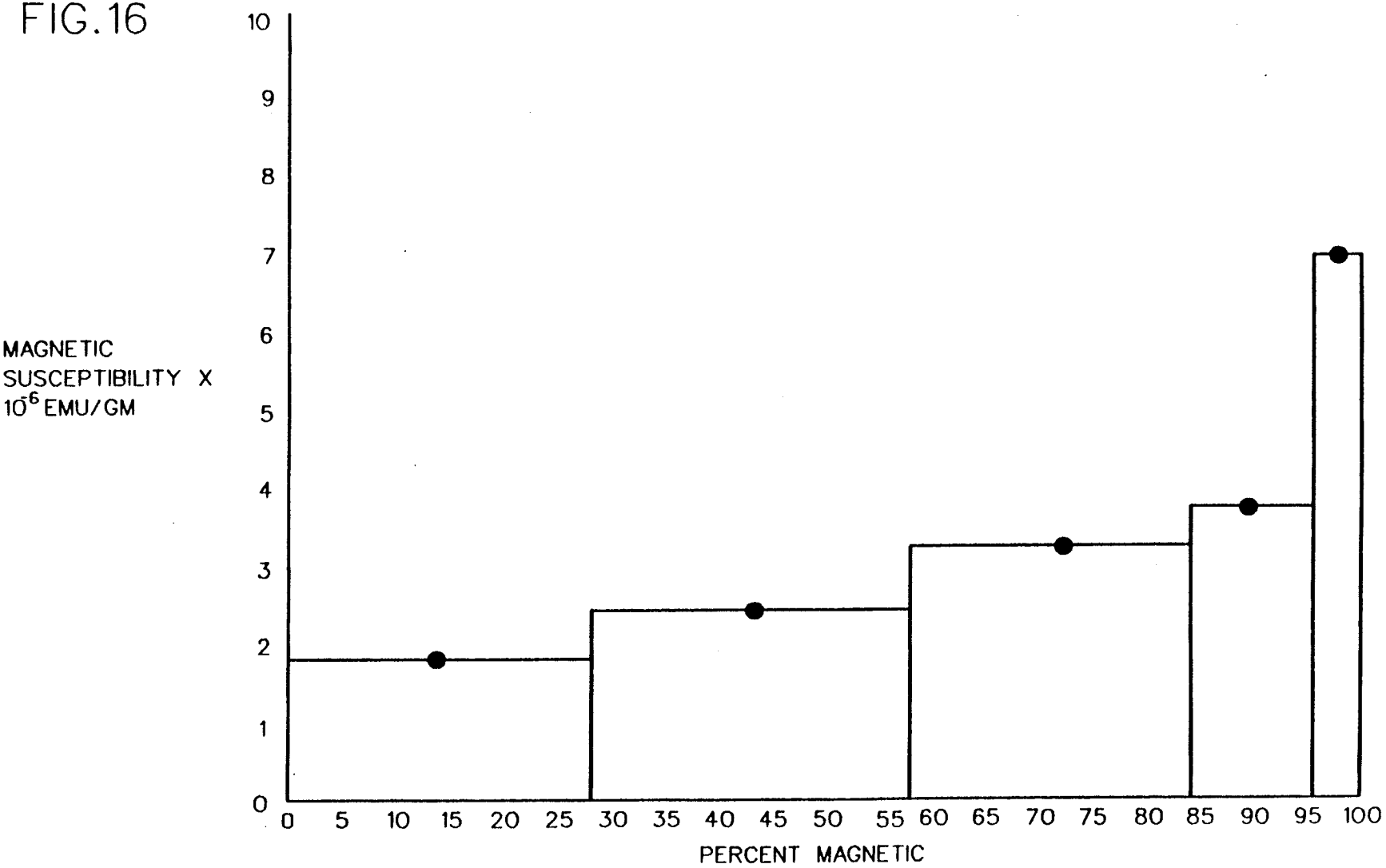
FIG. 16 plots magnetic susceptibility versus percent magnetic for an experiment similar to that of FIG. 14 but substituting holmium as the heavy rare earth magnetic hook. Holmium magnetic hook; 20% FOC-90 plus 6780 ppm holmium, 80% FOC-90 no additive calcined two hours 1200° F. air.
Figure 17:
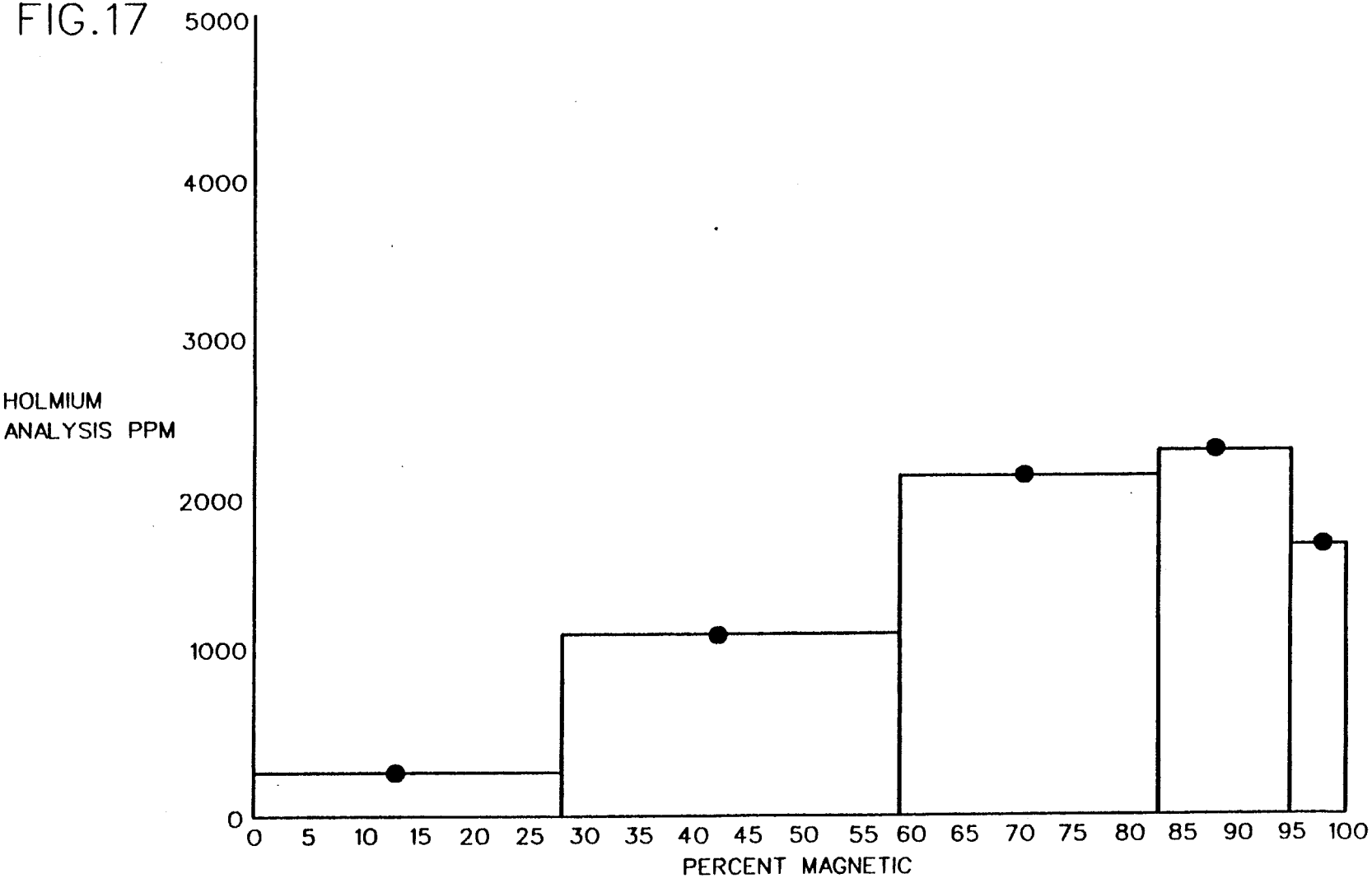
FIG. 17 plots chemical analysis versus percent magnetic and is analogous to FIG. 15 but substitutes holmium as the heavy rare earth magnetic hook, showing the most rare earth-loaded fractions are also (approximately) the most magnetic. Holmium magnetic hook; 20% FOC-90 plus 6780 ppm holmium, 80% FOC-90 no additive calcined 2 hours 1200° F. air.

Table 14 shows similar data for holmium and FIGS. 16 and 17 show the same behavior. In actual practice, because of the continuing addition of "magnetic hook" heavy rare earth to the circulating catalyst, a concentration gradient of heavy rare earth would also result, and concentrations of heavy rare earth in the oldest portion could rise to as high as 50,000 ppm or higher depending on the level of addition (see FIG. 3). Because the additive laydown rate is determined by the outside exposed surface of each sphere, smaller particles would accumulate heavy rare earths somewhat more rapidly than larger particles. But because contaminated metal, especially nickel, is also laid down by the same mechanism, the effect of the additive would thereby also relate to metal content, and hence, the degree of effectiveness.

TABLE 13

Dysprosium Additive
20% catalyst 6,500 ppm in dysprosium
80% catalyst - no additive
Calcined in air 1200° F. - two hours

| Cut # | Wt. % Mag. Fractions | Iron ppm | Dysprosium ppm | Mag. Suscept. $Xg \times 10^{-6}$ emu/gm. |
|---|---|---|---|---|
| 1 | 5.3 | 5,032 | 2,000 | 6.91 |
| 2 | 14.2 | 4,683 | 2,900 | 3.39 |
| 3 | 26.5 | 4,543 | 2,300 | 3.94 |
| 4 | 27.4 | 4,683 | 920 | 2.60 |
| 5 | 26.6 | 4,683 | 190 | 2.06 |

TABLE 14

Holmium Additive
20% catalyst 6,780 ppm holmium
80% catalyst - no additive
Calcined in air 1200° F. - two hours

| Cut # | Wt. % Mag. Fractions | Iron ppm | Holmium ppm | Mag. Suscept. $Xg \times 10^{-6}$ emu/gm. |
|---|---|---|---|---|
| 1 | 4.6 | 5,103 | 1,700 | 7.09 |
| 2 | 11.5 | 4,613 | 2,200 | 3.57 |
| 3 | 26.3 | 4,543 | 2,000 | 3.11 |
| 4 | 29.2 | 4,613 | 1,100 | 2.37 |
| 5 | 28.4 | 4,613 | 280 | 1.90 |

Table 15 shows the magnetic susceptibility of the base catalyst without promoter as well as the iron content and wt. % of each fraction.

TABLE 15

100 Catalyst - no additive
Calcined in air 1200° F. - two hours

| Cut # | Wt. % Mag. Fractions | Iron ppm | Mag. Suscept. $Xg \times 10^{-6}$ emu/gm. |
|---|---|---|---|
| 1 | 7.6 | 3,635 | 5.10 |
| 2 | 6.3 | 3,495 | 2.53 |
| 3 | 20.7 | 3,425 | 2.10 |
| 4 | 27.0 | 3,285 | 1.77 |
| 5 | 38.9 | 3,355 | 1.87 |

Figure 3:
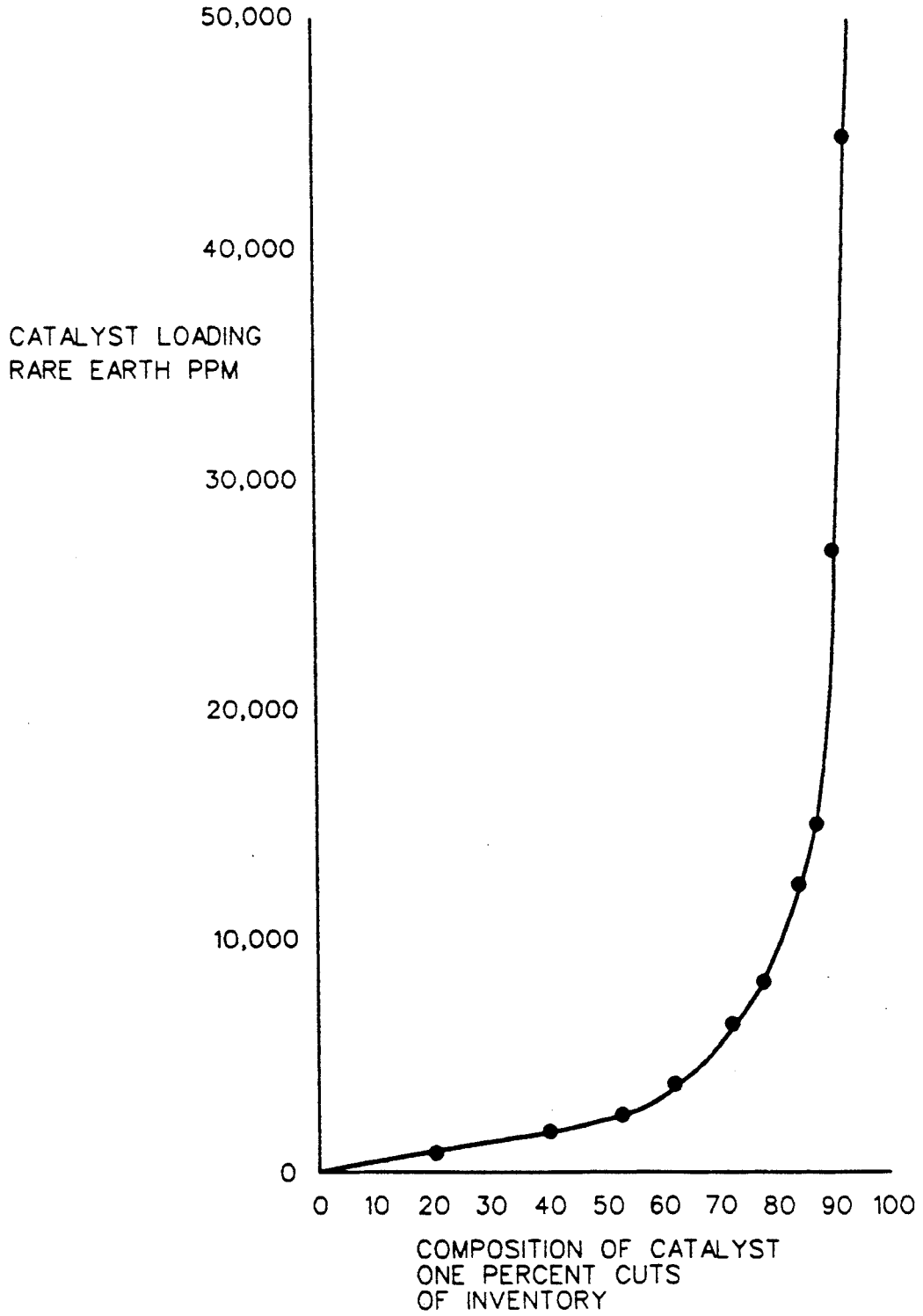
FIG. 3 is a plot of the distribution of rare earths, (ppm) versus the cumulative percent of feed, showing that e.g. 10% of the catalyst has more than 27,000 parts per million of the heavy rare earths used to make the separations of the invention ppm rare earth loading daily 5% replacement catalyst, 1 million pound catalyst inventory. Feed rate of reduced crude is 40,000 bbl/day with 10 ppm rare earth in feed.
Figure 4:
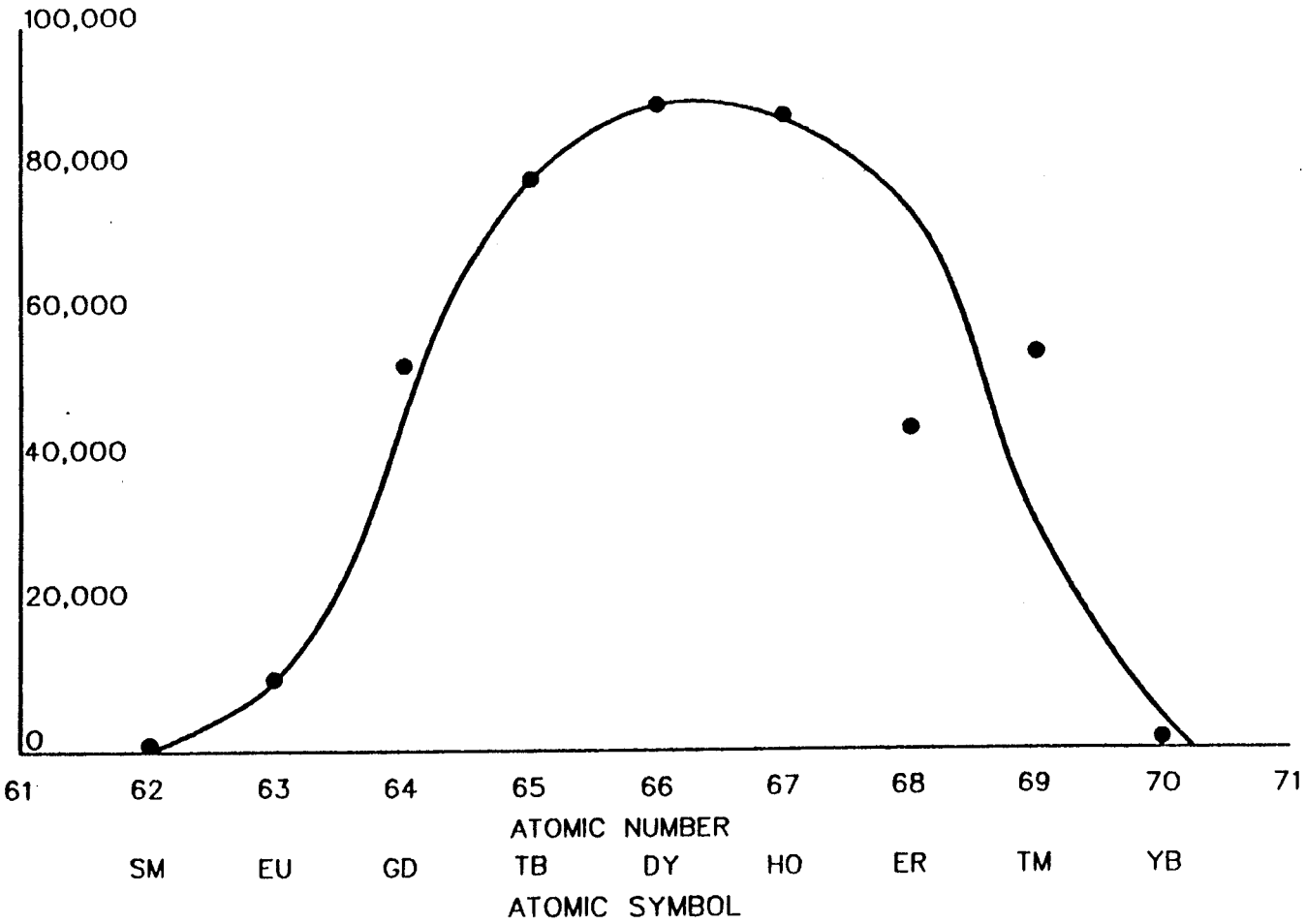
FIG. 4 is a plot of magnetic susceptibility in electromagnetic units (emu) for one gram formula weight of rare earth oxide versus atomic number of the individual heavy rare earths, showing that the atomic numbers from 64 to 69 provide six good heavy rare earth candidates for magnetic separation "hooks".
Figure 18:
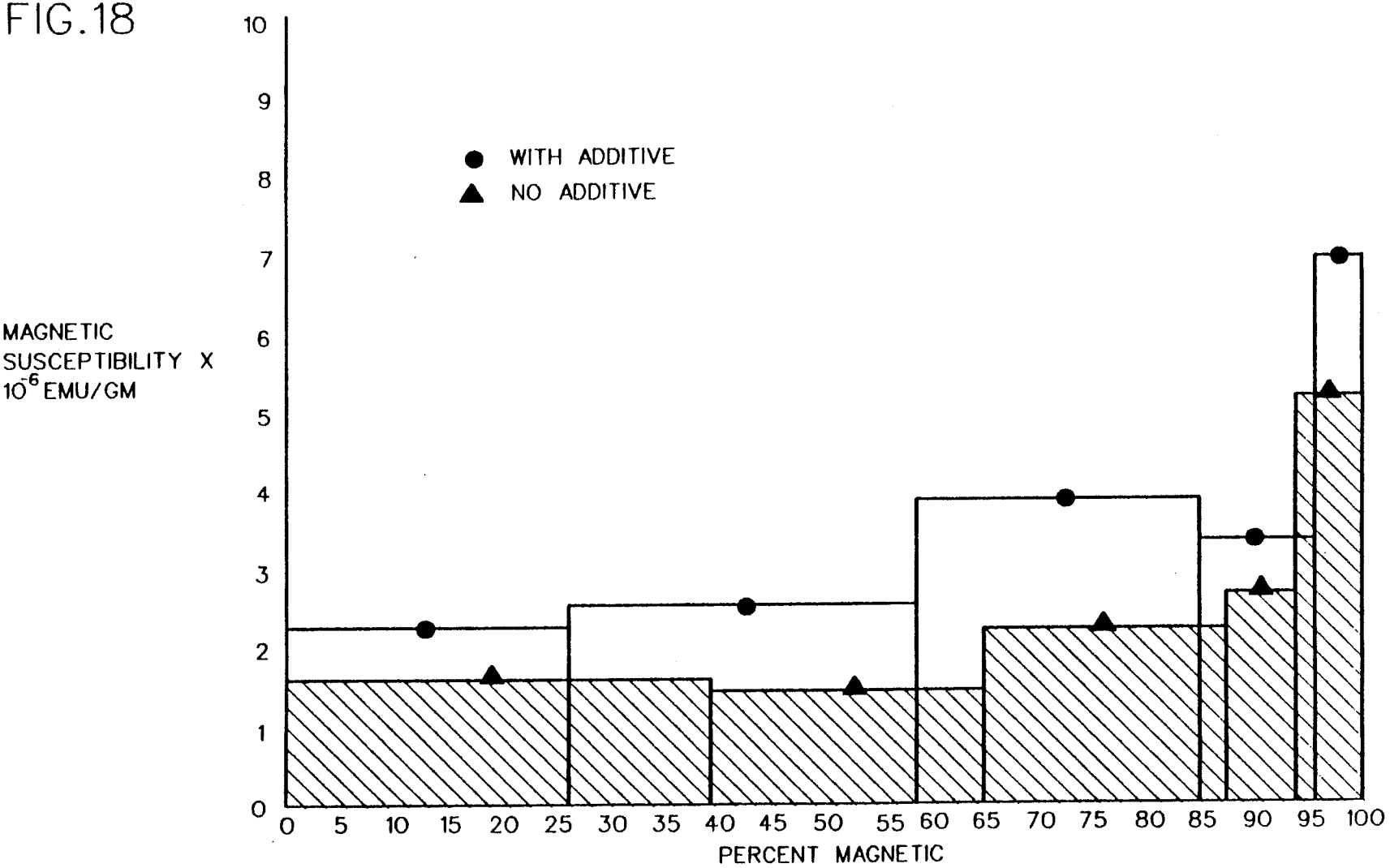
FIG. 18 plots magnetic susceptibility versus percent magnetic and compares fractions of untreated catalysts (triangles) with dysprosium-treated similar catalysts to show the additional beneficiation achieved by addition of rare earth magnetic hooks prior to magnetic separation. (The same rare earth roller-belt magnetic separator was used to accomplish all magnetic separations shown in this patent application. All parts per million are expressed as weight parts per million.) The high gradient magnetic separator (HGMS) described in our U.S. Pat. No. 4,406,773 can produce similar results. Dysprosium magnetic hook; 20% FOC-90 with 6500 ppm dysprosium mixed with 80% FOC-90 calcined two hours 1200° F. air.
Figure 19:
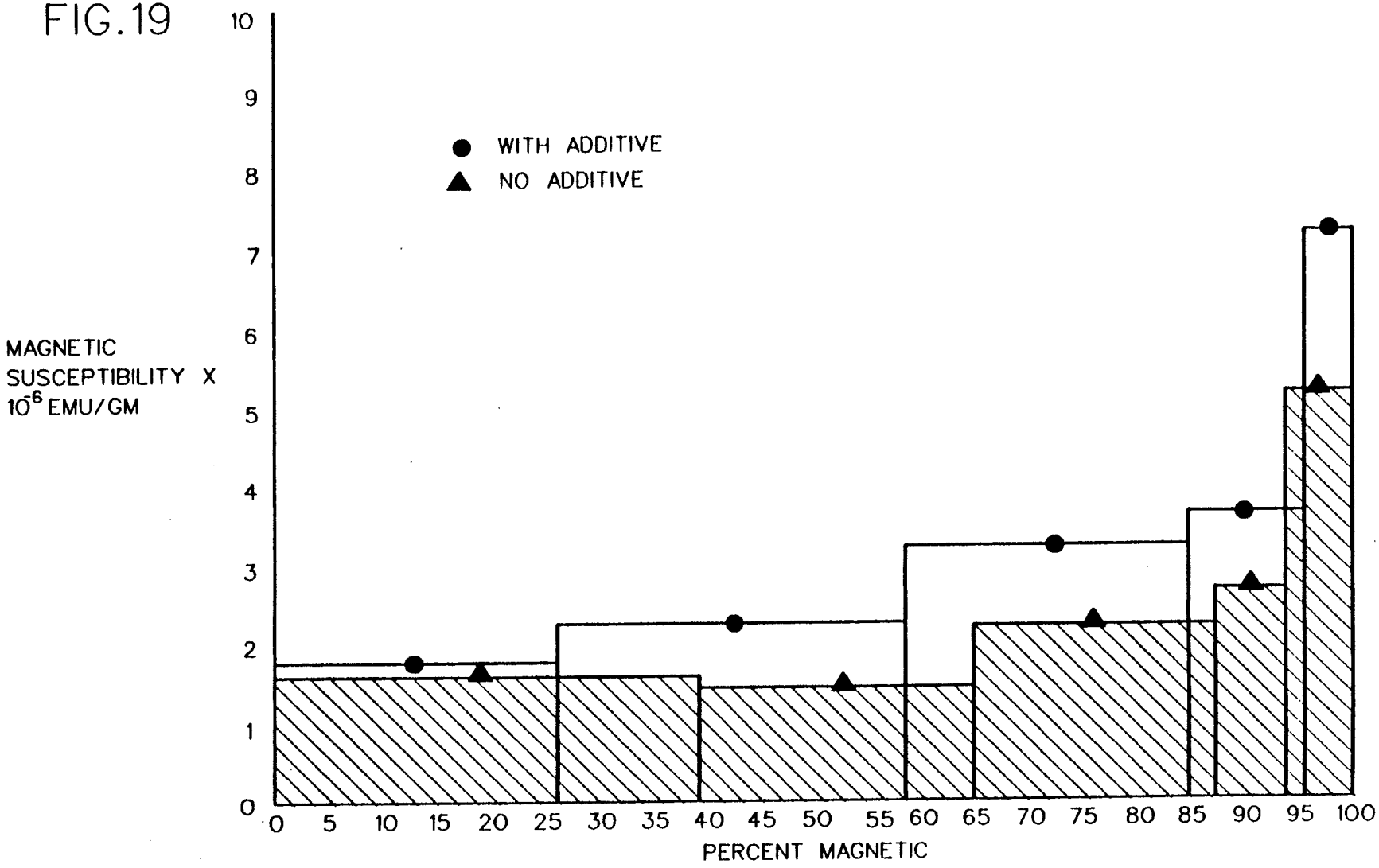
FIG. 19 plots magnetic susceptibility versus percent magnetic fraction and is analogous to FIG. 18 except that holmium is employed as the magnetic hook, showing the beneficiation accomplished by adding holmium before magnetic separation. Holmium magnetic hook; 20% FOC-90 plus 6780 ppm holmium, 80% FOC-90 no additive calcined two hours 1200° F. air.

FIG. 18 shows a plot of magnetic susceptibility for dysprosium and compared with the base case and FIG. 19 shows a similar plot for holmium. In both cases, it can be seen that the heavy rare earth greatly increased the paramagnetic properties even at the lower metal level. In practice, the older catalyst in the upper 80% level of magnetic fraction, as shown in FIG. 3, will be way above this level, and even better separation will result.

Cost Reduction

As can be seen, the heavy rare earths make excellent magnetic hooks. One of the major drawbacks to the greater alternate use of the heavy rare earths is the cost of many of them. One way to reduce cost is to subject spent catalyst to chemical treatment so as to recover rare earths for recycling, and this particularly envisions chemical recovery of rare earths and recycling back to the unit so that eventually in a closed-loop circuit system, the cost of the rare earths become very minor. Also, because of the relatively high magnetic susceptibility of all six of these elements, high purity is not a necessary requirement in recycling, nor is it a necessary requirement for the initial use of these elements as indicated. Separated or unpurified combinations of two or more of the heavy rare earths can be used in the process.

Modifications

Specific compositions, methods, or embodiments discussed are intended to be only illustrative of the invention disclosed by this specification. Variation on these compositions, methods, or embodiments are readily apparent to a person of skill in the art based upon the teachings of this specification and are therefore intended to be included as part of the inventions disclosed herein.

Reference to documents made in the specification is intended to result in such patents or literature being expressly incorporated herein by reference including any patents or other literature references cited within such documents.

What is claimed is:

1. A hydrocarbon catalytic cracking process which utilizes magnetic separation for removal of older cracking catalyst in a fluid bed conversion system, said process comprising:

a. Continuous or periodic addition of a paramagnetic active heavy rare earth containing compound to the circulating catalyst so as to accumulate heavy rare earth on individual catalyst particles as a function of the time that the particle has been in the unit;

b. Separating particles containing higher concentrations of paramagnetic heavy rare earth with higher magnetic properties by magnetic means;

c. Returning lower concentration heavy rare earth-containing catalyst particles of higher activity back to the system.

2. A process as claimed in claim 1 wherein more than 0.1 ppm nickel and 0.1 ppm vanadium is contained in the feedstock, said processing comprising:

a. addition of a paramagnetic active heavy rare earth-containing compound to the circulating catalyst so as to accumulate heavy rare earth on individual catalyst particles as a function of the time that the particle has been in the unit, said rare earth-containing compound being added at a rate of 0.1 to 5 times the concentration of nickel plus vanadium;

b. Separating particles containing higher concentrations of paramagnetic heavy rare earth and thereby higher magnetic properties by magnetic means;

c. Returning lower concentration heavy rare earth-containing catalyst particles of higher activity back to the system.

3. A process as claimed in claim 1 whereby heavy rare earth is added continuously or periodically to the feedstock, so as to deposit on the catalyst in amounts in the range of 100 to 30,000 ppm.

4. A process as claimed in claim 1 whereby heavy rare earth is added continuously or periodically to the feedstock so as to deposit on the catalyst in amounts in the range of 0.1 to 10 times the nickel equivalent.

5. A process as claimed in claim 1 whereby heavy rare earth is added continuously or periodically directly to the catalyst by means of water or organic solvent, so as to deposit on the catalyst in amounts in the range of 100 to 30,000 ppm.

6. A process as claimed in claim 1 wherein said heavy rare earth additive is added continuously or periodically directly to the catalyst as an inorganic compound.

7. A process as claimed in claim 1 wherein said heavy rare earth additive is added continuously or periodically directly to the catalyst as an organic compound.

8. A process as claimed in claim 1 wherein said heavy rare earth additive is added continuously or periodically directly to the catalyst as a water soluble compound.

9. A process as claimed in claim 1 wherein said heavy rare earth additive is added continuously or periodically directly to the catalyst as an oil soluble compound.

10. A process as claimed in claim 1 wherein said heavy rare earth additive is added in an organic solvent to the hydrocarbon feedstock.

11. A process as claimed in claim 1 wherein said heavy rare earth additive is added as heavy rare earth acetylacetonate directly to recycled catalyst or dissolved in the hydrocarbon feedstock.

12. A process as claimed in claim 1 wherein catalyst particles containing higher amounts of magnetically active heavy rare earth also contain higher levels of nickel equivalents and are separated by magnetic separation from catalyst particles containing lower amounts of magnetically active ions or elements and also lower nickel equivalents.

13. A process as claimed in claims 1 or 12 wherein the magnetic separation is achieved by means of a high gradient electromagnetic separation device of about 1,000 to 20,000 Gauss field strength.

14. A process as claimed in claims 1 or 12 wherein magnetic separation is achieved by means comprising a rare earth-containing magnetic roller.

15. A process as claimed in claims 1 or 12 wherein magnetic separation is achieved by means comprising a ferrite roller magnetic separator.

16. A process as claimed in claims 1 or 12 wherein magnetic separation is achieved by means comprising a superconducting magnetic separator (SCHGMS).

17. A process as claimed in claim 16 wherein the SCHGMS operates in the range of about 10,000 to 50,000 Gauss field strength.

18. A process as previously claimed in claims 1 or 12 wherein the feedstock has a Conradson Carbon number greater than 1.

19. A process as previously claimed in claims 1 or 12 wherein the feedstock has an API gravity between 10 and 30.

20. A process as previously claimed in claims 1 or 12 wherein the process is carried out in a reduced crude conversion unit.

21. A process as previously claimed in claims 1 or 12 wherein the process is carried out in a fluid catalytic cracker.

22. A process as claimed in claims 1 or 12 wherein the catalyst has a nickel equivalent, excluding iron, of 1,000 ppm or greater.

23. A process as claimed in claims 1 or 12 wherein the catalyst has a nickel equivalent, excluding iron, of 500 ppm or greater.

24. A process as claimed in claims 1 or 12 wherein heavy rare earth is added as a sulfate, chloride, acetate, carbonate, nitrate or perchlorate.

25. A process as claimed in claims 1 or 12 wherein heavy rare earth is added as a carbonyl or acetylacetonate.

26. A process as claimed in claims 1 or 12 wherein heavy rare earth is added as colloidal heavy rare earth oxide or dioxide.

27. A process as claimed in claims 1 or 12 wherein heavy rare earth is added at a rate to produce a circulating catalyst with an overall concentration of heavy rare earth greater than 500 ppm.

28. A process as claimed in claims 1 or 12 wherein heavy rare earth is added at the rate of 0.1 to 100 ppm of oil.

29. A process as claimed in claims 1 or 12 wherein catalyst comprises 50 to 50,000 ppm heavy rare earth deposited on said catalyst, and comprises more than 5 wt. % active zeolite.

30. A method of preparation of a heavy rare earth promoted cracking catalyst for use in a process as claimed in claims 1 or 12 consisting of:

a. Dispersing catalyst in water in the amount of ½ to 5 times water per unit of catalyst;

b. Dissolving a water soluble compound of heavy rare earth in ½ to 5 times water per unit of catalyst so as to deposit 500 to 50,000 ppm of heavy rare earth on said catalyst;

c. Filtering off excess water after at least one hour contact of rare earth solution with catalyst slurry;

d. Drying said catalyst so as to remove excess water; and e. Calcining said catalyst at 1200° F. before use, or introducing dried catalyst directly to a hydrocarbon cracking fluid unit.

31. A process as claimed in claims 1 or 12 wherein a combination of iron and heavy rare earth salts or organic compounds at ratios of 1:5 to 5:1 of heavy rare earth to iron, are added continuously and/or periodically to provide a magnetic hook for separation of old catalyst from new.

32. A process as claimed in claims 1 or 12 wherein the heavy rare earth comprises gadolinium.

33. A process as claimed in claims 1 or 12 wherein the heavy rare earth comprises terbium.

34. A process as claimed in claims 1 or 12 wherein the heavy rare earth comprises dysprosium.

35. A process as claimed in claims 1 or 12 wherein the heavy rare earth comprises holmium.

36. A process as claimed in claims 1 or 12 wherein the heavy rare earth comprises erbium.

37. A process as claimed in claims 1 or 12 wherein the heavy rare earth comprises thulium.

38. A process as claimed in claims 1 or 12 wherein the additive is a combination of one or more of the heavy rare earth elements.

39. A process as claimed in claims 1, 2 or 12 whereby one or more of the heavy rare earth additives are chemically recovered from magnetic separated catalyst and recycled back to the process described, in claims 1, 2, or 12.

* * * * *